United States Patent [19]

Monahan

[11] Patent Number: 4,712,402

[45] Date of Patent: Dec. 15, 1987

[54] INTEGRALLY AND SEQUENTIALLY RE-KEYABLE LOCK APPARATUS AND METHOD

[76] Inventor: Brian J. Monahan, 28895 Cragmont Dr., Evergreen, Colo. 80439

[21] Appl. No.: 874,993

[22] Filed: Jun. 16, 1986

[51] Int. Cl.[4] ..... E05B 25/00

[52] U.S. Cl. ..... 70/383; 70/384

[58] Field of Search ..... 70/360, 361, 382, 383, 70/384, 385

[56] References Cited

U.S. PATENT DOCUMENTS

| | | | |
|---|---|---|---|
| 1,513,718 | 10/1924 | Morehouse . | |
| 1,819,853 | 8/1931 | Von Mehren . | |
| 1,896,319 | 2/1933 | Littell | 70/382 |
| 2,113,007 | 4/1938 | Swanson . | |
| 2,326,358 | 8/1943 | Hull . | |
| 2,427,837 | 9/1947 | Connell . | |
| 2,910,860 | 11/1959 | Camba | 70/360 |
| 3,125,878 | 3/1964 | Gutma . | |
| 3,175,378 | 3/1965 | Russell . | |
| 3,320,781 | 5/1967 | Hill . | |
| 3,422,646 | 1/1969 | Monahan . | |
| 3,473,355 | 10/1969 | Saito | 70/384 |
| 3,589,153 | 6/1971 | Hill . | |
| 3,667,262 | 6/1972 | Hill . | |
| 3,756,049 | 9/1973 | Kerr . | |
| 4,440,009 | 4/1984 | Smith . | |

FOREIGN PATENT DOCUMENTS

| | | | |
|---|---|---|---|
| 1125046 | 6/1982 | Canada | 70/383 |
| 6765 | 1/1983 | European Pat. Off. . | |

*Primary Examiner*—Robert L. Wolfe

*Attorney, Agent, or Firm*—Chester E. Martine, Jr.

[57] ABSTRACT

A lock is re-keyable for sequential use with different ones of a set of change keys, without disassembling the lock or removing or replacing any parts therefrom or therein. A housing of the lock has a bore extending axially therethrough to define a shear interface and receive a plug for rotational and axial movement, with one rearward axial position for operation of the lock and another forward axial position for re-keying. The plug is held fixed rearwardly by a retainer to form pinways. According to which change key currently operates the lock, a particular reset key selectively positions at least one master pin in either the plug portion or the housing portion of the second pinway. The reset key releases the retainer and the plug is moved forward axially to align a third pinway with the master pin in the housing portion or a first pinway with the master pin in the plug portion. The reset key is removed and a corresponding set key is inserted into the lock. The set key transposes the master pin across the shear interface from the housing portion into the plug portion of the third pinway or from the plug portion into the housing portion of the first pinway. The plug is rotated to release the retainer and the plug is moved axially to the operational position. The lock is then not usable with the first change key, and is usable only with the next sequential change key, and with a master key.

27 Claims, 21 Drawing Figures

INTEGRALLY AND SEQUENTIALLY RE-KEYABLE LOCK APPARATUS AND METHOD

BACKGROUND OF THE INVENTION

Field of the Invention

The present invention relates to locks and more particularly to an apparatus for and method of re-keying a pin tumbler cylinder lock having tumbler pins, driver pins and at least one master pin without disassembly of the lock apparatus or removal or replacement of any master pins therefrom or therein.

Description of the Prior Art

The pin tumbler lock principle is widely used in builders hardware locks, padlocks and cabinet locks. A pin tumbler lock housing has a cylindrical main bore extending longitudinally therethrough to rotatably accommodate a cylindrical plug having a flange at its front end to limit its rearward movement relative to the housing. The plug has a keyway extending longitudinally therethrough at the bottom of the plug. A plurality of parallel and equally spaced cylindrical top pinways perpendicular to the main bore extend from the top of the housing into the main bore to align with correspondingly spaced cylindrical bottom pinways extending from the top of the plug to part way into the keyway. Retainers of various types secured to the rear end of the plug provide a minimum of end play between the plug and the housing when the lock is assembled. Each pinway extending from the top of the housing to part way into the keyway has within it a tumbler pin having a truncated conical bottom end that engages a truncated cut or bitting on the top edge of a key inserted in the keyway. The bitting positions the tumbler pin vertically in the pinway. Above each tumbler pin is a driver pin of sufficient height to block a shear interface between the plug and the housing when the tumbler and driver pins are bottomed in their pinway. Above each driver pin is a compression spring that biases the driver pin and the tumbler pin in a downward direction. The height of a tumbler pin is such that the interface between the tumbler pin and the driver pin is located at the shear interface by a properly selected bitting on a key inserted in the keyway. When the key bittings locate all such driver pin and tumbler pin interfaces at the shear interface, the plug is free to rotate and retract a bolt or latch by means of the surfaces of the retainer, or an extension thereof, acting on the bolt or latch.

Tumbler pin heights and bitting depths of the key are multiples of an increment established by the manufacturer. There are usually ten tumbler pin heights and ten corresponding bitting depths numbered zero through nine, zero designating the shortest tumbler and the shallowest bitting depth and nine designating the tallest tumbler and the deepest bitting depth. The increment is large enough to ensure that a key having one or more bitting depths shallower or deeper than corresponding tumblers will not permit the plug to rotate because of the normal clearance between the plug and the housing.

A key that is intended for use with an individual lock or a group of locks keyed alike is referred to as a change key. A key that will operate a group of locks, each of which is operated by its own unique change key, is referred to as a master key. Pin tumbler locks are masterkeyed by using short pins called master pins between the tumbler pin and the driver pin in a given pinway. A tumbler pin, a driver pin and any master pins between them can be referred to as a tumbler stack. The interface between a master pin and a driver pin usually determines the change key bitting, and the interface between the tumbler pin and the master pin determines the master key bitting. A plurality of locks can thus be set up to each operate with its own unique change key, yet all of the locks can be operated with the same master key.

For ease of reference, the locations of each pinway, and thus the location of the bitting for operating the tumbler stack in that pinway, are referred to as stations designated by the letters A, B, C, etc. with station A relating to the pinway that is closest to the front of the lock.

The necessity to re-key locks is an ongoing problem, particularly with a turnover of employees and tenants. Some concerns, such as banks, consider re-keying on a periodic basis to be a matter of good policy. Normally, re-keying the change key of a lock requires disassembly of the lock and removal and replacement of tumbler pins with tumbler pins of different heights if the lock is not masterkeyed. If masterkeyed, removal and replacement with different-height master pins has been required. Ideally, the delay in waiting for and the expense of a locksmith are to be avoided.

Attempts have been made to re-key locks by providing a slot in the plug for receiving a slide having eight holes for use with four pinways. When the lock is assembled, the extra or auxilliary holes are either empty, filled with master pins having a height that is equal to the full thickness of the slide or filled with master pins that are shorter than the full thickness of the slide. A set screw is used to move the slide in the slot into one of two positions to align two different sets of the holes with the pinways. Because of the different arrangement of holes and master pins in each of the two positions of the slide, a different change key is required to operate the lock for each position of the slide. However, without increasing the length of the lock, or disassembling the lock, the lock can be re-keyed for only two change keys.

Other attempts to re-key a lock to provide operation with more than two change keys have increased the length of the housing to provide more pinways in the housing than in a plug received in the housing. A set screw holds the plug in alignment with three different sets of the housing pinways, where each set has a different pin combination that requires change keys having different bittings. Although the lock can be re-keyed for use with any of the three different change keys, the increased length of the lock limits the situations in which the lock can be used.

Although also provided with a housing having an increased length, another re-keyable lock was provided with a spring biased plunger extending from the housing into a plug that was slidable in the housing for alignment with three different sets of pinways in the housing. A special key inserted into the keyway was used to operate the plunger to release the plug and allow it to slide rearwardly in the housing. The special key was easier to use than the set screw for re-keying the lock. However, unless the lock was disassembled it could be re-keyed for use with only three different change keys and the housing had an increased length to provide more pinways than the number of pinways in the plug.

Others have re-keyed a lock by using a special key having a bitting that locates a pin in the housing pinway to facilitate removal of the pin from the lock. The pin remains in the housing pinway when the special key and the plug are rotated 180°. The removable pin is then transferred from the housing pinway into a slot formed in the special key. The special key and the removable pin are then removed from the lock. To enable the lock to be used with increased quantities of change keys, another special key is used to insert new removable pins into the lock, which requires careful handling of the very small removable pin.

Also in the past, locks have been keyed for operation using many keys, including, for example, a key for use only during construction. Special keys have been used to lock-out or prevent use of the construction key with the lock, while all of the rest of the original keys can operate the lock. However, the special key and the structure of the lock do not render the lock usable with only one of the many keys instead of the construction key that is locked-out.

SUMMARY OF THE INVENTION

In contrast to the prior art in which the number of different change keys usable with a re-keyable lock depends on how many extra pinways are provided in the housing at the lock, preferred embodiments of the present invention provide a re-keyable lock usable with substantially increased numbers of different change keys to achieve the following objectives.

Initially, the present invention utilizes a change principle wherein master pins can be transposed directly from one pinway to the next adjacent pinway in the lock to provide different, exclusive change key bitting combinations or settings.

Secondly, only one exclusive change key bitting at a time can operate the lock and there are a minimum of master pins for a maximum number of change keys and maximum pick resistance, yet there is always a master key.

Thirdly, to adapt a standard, existing lock to use the principles of the present invention, few changes need be made to the housing and the plug of the existing lock and only two special keys need be provided for each re-keying operation.

Fourthly, the method of the present invention re-keys a lock using only two special keys and a series of steps involving only the movement of the plug of the lock partially out of the bore, rotation of the plug and movement of the plug back into the bore.

With these and other objects in mind, a pin tumbler lock apparatus in accordance with the present invention is provided with a lock for sequential exclusive use with the first and second change keys and use with a reset key and a set key for re-keying said lock for use with only one of the change keys. The lock includes a lock cylinder housing with a cylindrical bore extending longitudinally therethrough from a first end to a second end. Longitudinally spaced, elongated top pinway portions in the housing extend perpendicular to and radially outward from the cylindrical bore. A cylindrical plug is positioned rotatably in and defines a shear interface with the bore. The plug has a longitudinal keyway therein for receiving a key bit and has longitudinally spaced bottom pinway portions extending radially inward from the peripheral surface thereof into the keyway. Opposite pairs of the bottom and top pinway portions are adapted to align with each other to form common first, middle and third pinways. A top driver pin and a bottom tumbler pin are slidably positioned in each of the common pinways. The plug is rotatable when the interface between the top and bottom pins is aligned with the shear interface and is not rotatable when a pin is positioned across the shear interface. The lock is provided with at least one master pin adapted to be selectably positioned in any one of the common pinways for providing an additional interface between the top and bottom pins therein to align with the shear interface. The location of the master pin in different ones of the common pinways requires the use of a different one of the change keys.

The lock is improved in that the bore is provided with a second groove that is longitudinally spaced from an inner end of the housing by the distance between the common pinways. The second groove is arcuate and eccentric with respect to the bore so that it extends into the bore for a limited distance along the circumference of the bore to form a cam surface. Also, a retainer is carried by the plug for movement transverse thereto across the inner end into a first groove at the inner end to hold the plug in a first longitudinal position relative to the bore so that the pinways are aligned to form the common pinways. The retainer extends across the keyway and has a cut therein forming a cam follower for moving the retainer out of the first groove. When the retainer is moved out of the first groove, the plug is released and is movable longitudinally in the bore into the second groove. The second groove holds the plug in a second longitudinal position relative to the bore so that the bottom and top pinways become aligned with respective opposite adjacent top and bottom pinway portions.

With the master pin positioned in the middle common pinway, the lock is usable with a first reset key adapted for insertion into the keyway and being bitted on one side for conditioning the master pin for movement into the first common pinway. A second reset key is also adapted for insertion into the keyway and is bitted on one side for conditioning the master pin for movement into the third common pinway. Each of the first and second reset keys conditions the master pin by selectively positioning the master pin above or below the shear interface. Each also has a leading edge provided with a cam for cooperating with the cam follower to move the retainer out of the first groove when the master pin is selectively positioned by the respective reset key. The plug then slides into the second longitudinal position relative to the bore so that the retainer moves into the second groove to hold the plug in the second position.

To complete the re-keying, a first set key is inserted into the keyway when the plug is in the second longitudinal position following use of the first reset key. The first set key is bitted for transferring the master pin from the bottom pinway portion of the middle common pinway into the top pinway portion of the first common pinway. Also provided is a second reset key adapted for insertion into the keyway when the plug is in the second longitudinal position after use of the second reset key. The second set key is bitted for transferring the master pin from the top pinway portion of the middle common pinway into the bottom pinway portion of the third common pinway. Each of the first and second set keys is adapted for rotating the plug to retain the master pin in the respective top and bottom pinway portions. The cam surface of the arcuate second groove is effective upon rotation of the plug to move the retainer out of the arcuate second groove to allow the plug to slide longitudinally in the bore into the first position so that the common pinways are again formed. The master pin is then in the new common pinway, which is the first common pinway when the first reset and set keys are used and is the third common pinway when the second reset and set keys are used. The lock is thus re-keyed for use with a change key adapted for use only when the master pin is in that new common pinway location.

The method of the present invention is effective to re-key the lock for successive use with different ones of a plurality of different change keys without disassembling the lock or removing or replacing any parts therefrom or therein. With the master pin initially in the second common pinway, the first step of the method is to hold the plug fixed axially with the aligned holes forming the first and second pinways. The master pin is then selectively positioned in either the top or the bottom pinway portion of the second pinway. The plug is then moved axially in the bore into the second longitudinal position. If the master pin was in the bottom pinway portion, the master pin is thus aligned with the first pinway. If the master pin was in the top pinway portion, the third bottom pinway portion is now aligned with the master pin. Then the master pin is moved across the shear interface into the opposing pinway portion. The plug is rotated to retain the master pin in that opposing pinway portion so that by moving the plug axially to again form the first and second common pinways the master pin is positioned in the selected common pinway. The selected common pinway is the first one if the master pin was initially positioned in the bottom pinway portion. The lock is thus re-keyed for use with the different change key.

BRIEF DESCRIPTION OF THE DRAWINGS

Other objects, features and advantages of the present invention will be apparent from an examination of the following detailed descriptions which include the attached drawings in which.

DESCRIPTION OF THE PREFERRED EMBODIMENT

Figures 1, 2, 3, 4:
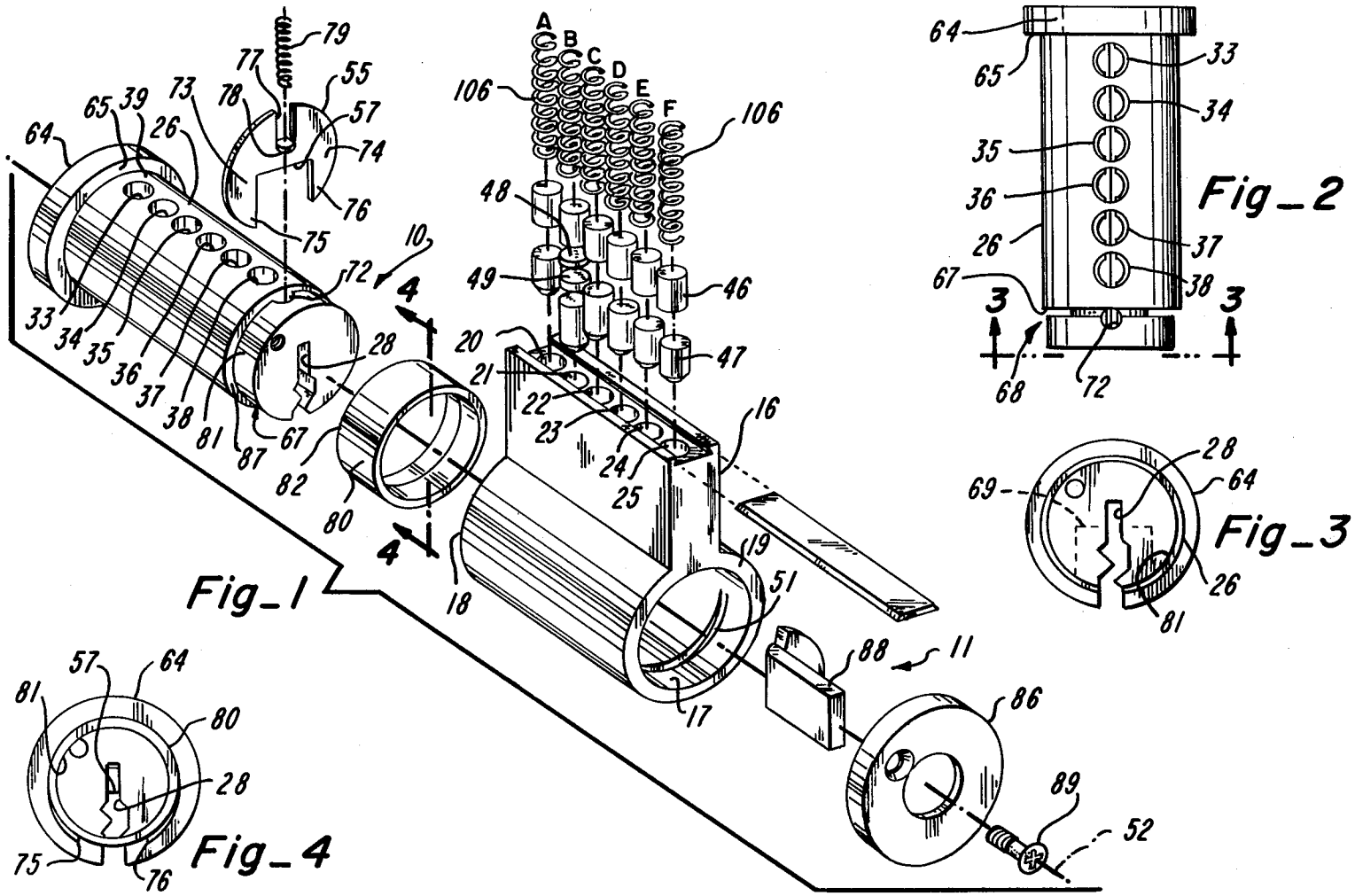
FIG. 1 is an exploded view of the lock of the present invention showing a housing having a bore for receiving a plug.
FIG. 2 is a top view of the plug showing a slot to receive a spring-loaded retainer.
FIG. 3 is a rear view of the plug shown in FIG. 1 showing the plug with broken lines indicating the shape of the slot that receives the spring-loaded retainer.
FIG. 4 is a rear view taken along line 4—4 in FIG. 1 showing the plug with the spring-loaded retainer in place and an internally-stepped sleeve capping the retainer spring and the bottom rear end of the keyway.

A first preferred embodiment of a lock apparatus 10 of the present invention is shown in FIGS. 1, 9A, 9B, 10A, 10B, 10C, 12 and 17 as including a lock 11 for sequential, exclusive use with a first change key 12 (FIG. 12) and second change key 13 (FIG. 17) and use with a first reset key 14 (FIGS. 13 and 14) and a first set key 15 (FIGS. 15 and 16) for re-keying the lock 11 for use with only one of the change keys 12 and 13. Referring in detail to FIG. 1, the lock 11 includes a lock cylinder housing 16 with a cylindrical bore 17 extending longitudinally therethrough from a first or front end 18 to a second or rear end 19. Longitudinally spaced, elongated top pinway portions 20, 21, 22, 23, 24 and 25 in the housing 16 extend perpendicular to and radially outward from the cylindrical bore 17. A cylindrical plug 26 is positioned rotatably in and defines a shear interface 27 (FIGS. 12 through 17) with the bore 17. The plug 26 has a longitudinal keyway 28 therein for receiving a key bit, such as a key bit 29 (FIG. 12) of the first change key 12 or respective key bits 30 (FIG. 17), 31 (FIG. 9A) or 32 (FIG. 10A) of the second change key 13, the first reset key 14 or the first set key 15. The plug 26 also has longitudinally spaced bottom pinway portions 33, 34, 35, 36, 37 and 38 extending radially inward from the peripheral surface 39 thereof into the keyway 28. Opposite pairs of the bottom and top pinway portions, such as portions 20 and 33, are adapted to align with each other to form common pinways 40, 41, 42, 43, 44 and 45 that extend in the housing 16 and the plug 26 in equally spaced longitudinal relationship (FIGS. 11 through 17). For purposes of description, the respective common pinways 40, 41 and 42 are referred to as the first, middle and third pinways.

A top or driver pin 46 and a bottom or tumbler pin 47 are slidably positioned in each of the common pinways 40 through 45. The plug 26 is rotatable when the interface between the respective top and bottom pins 46 and 47 is aligned with the shear interface 27 and is not rotatable when a pin, such as the driver pin 46 shown in FIG. 11, extends across the shear interface 27. The lock 11 is provided with at least one master pin, such as the master pin 48 or the master pin 49, adapted to be selectably positioned in any one of the common pinways 40 through 45 for providing an additional interface between the respective top and bottom pins 46 and 47 therein that can be aligned with the shear interface 27. The location of the master pins 48 and 49 in different ones of the common pinways 40 through 45 requires the use of a different one of the change keys 12 and 13. In FIGS. 11 through 17, for example, the master pin 48 is shown being transferred or transposed from the middle common pinway 41 to the first common pinway 40.

Figure 5:
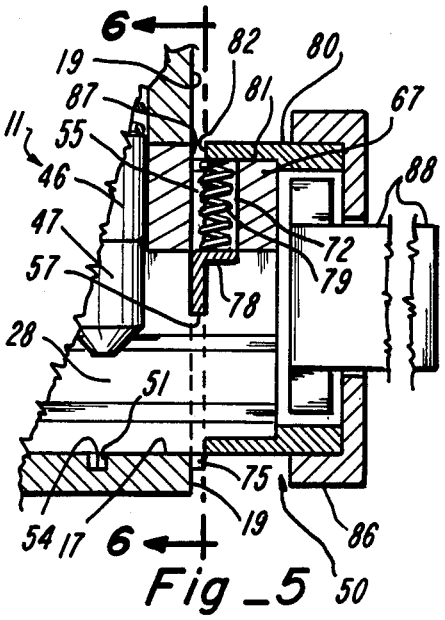
FIG. 5 is a partial transverse cross sectional view of the inner end of the lock of the present invention after assembly of the lock.
Figure 6:
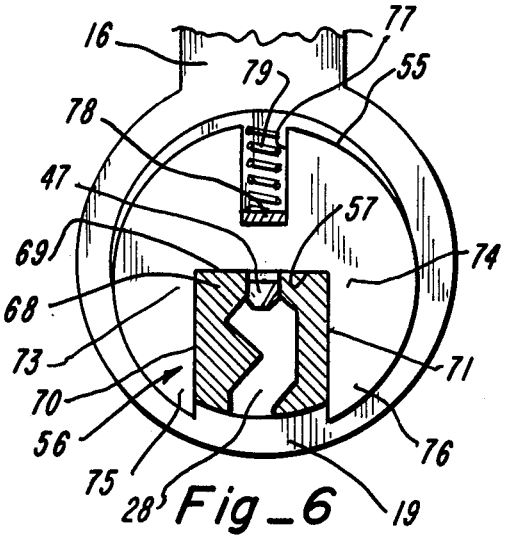
FIG. 6 is a cross-sectional view taken along line 6—6 in FIG. 5 showing a neck formed by the slot in the plug and the retainer straddling the neck.
Figure 8:
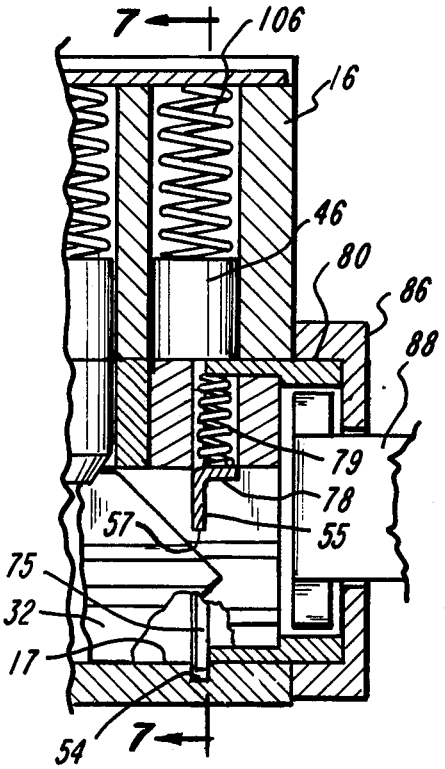
FIG. 8 is an enlarged portion of FIG. 14 with the plug cut away to show the retainer in the groove in the bore.
Figure 7:
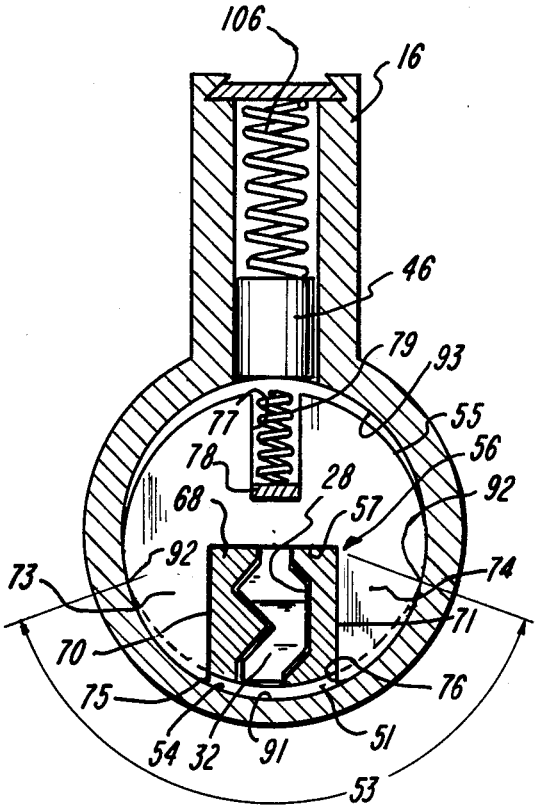
FIG. 7 is a cross sectional view taken along line 7—7 in FIG. 8 showing the retainer in a groove formed in the bore for holding the plug in a re-keying position.

Referring to FIG. 5, the lock 11 is shown improved in that it is provided with a pair of grooves 50 and 51 that are longitudinally spaced by the distance between adjacent common pinways, such as the first and middle common pinways 40 and 41. Referring to FIG. 7, the internal one of the grooves 51 is arcuate and eccentric with respect to the longitudinal axis 52 of the bore 17 so that it extends into the bore 17 for a limited arcuate distance 53 along the circumference of the bore 17 to form a cam surface 54. A retainer 55 is carried by the plug 26 for movement transverse thereto into the external groove 50 to hold the plug 26 in a first longitudinal position (FIGS. 5 and 11) relative to the bore 17 so that the common pinways 40 through 45 are formed. Transverse movement of the retainer 55 into the internal groove 51 holds the plug 26 in a second longitudinal position (FIGS. 14 and 15) relative to the bore 17 so that normally opposite pairs of top and bottom pinway portions, such as the respective portions 20 and 33, become aligned with respective opposite adjacent top and bottom pinway portions. For example, the top portion 20 becomes aligned with the bottom portion 34 that was adjacent and opposite to the top portion 21 in the first longitudinal position. Referring to FIG. 6, the retainer 55 extends across the keyway 28 and has a cut 56 therein forming a cam follower 57 for moving the retainer 55 out of the first groove 50.

Figure 9A:
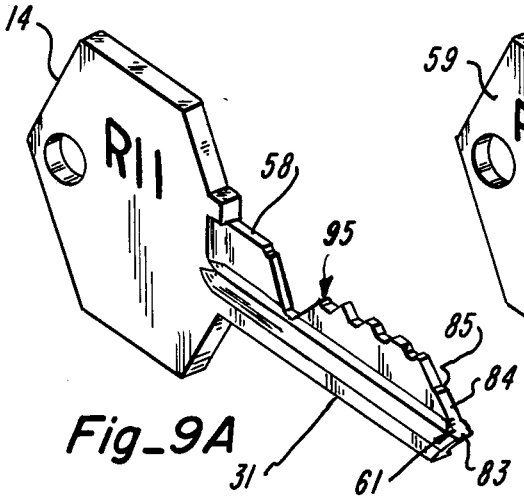
FIGS. 9A and 9B are views of respective first and second reset keys that are used to rekey the lock in order of respective increasing or decreasing change key identification numbers wherein each reset key has an extra bitting to release the retainer from an operational position.
Figure 9B:
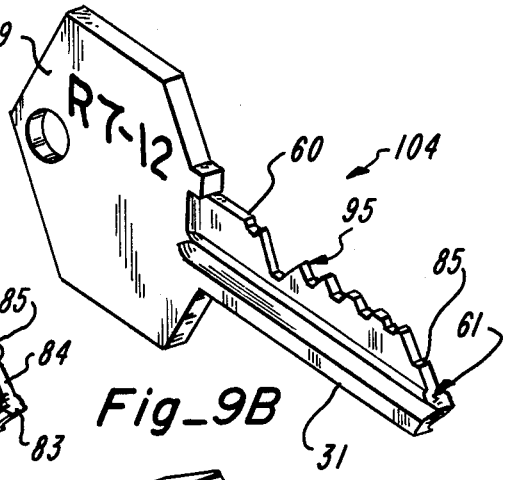
Figure 10A:
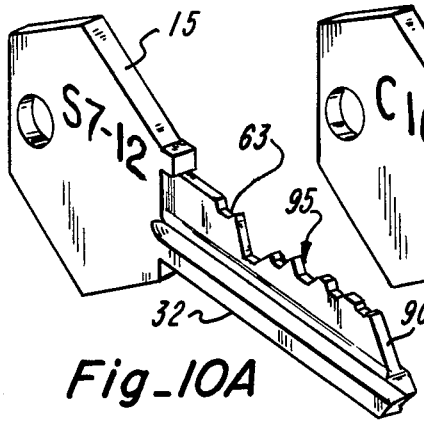
FIGS. 10A, 10B and 10C are views of respective first and second set keys and a master key, where the set keys are used to rekey the lock in order of respective increasing or decreasing change key identification numbers.
Figure 10B:
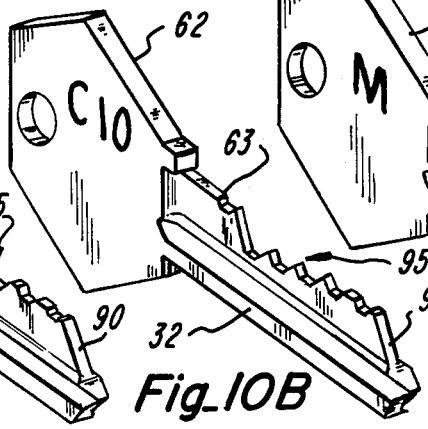
Figure 10C:
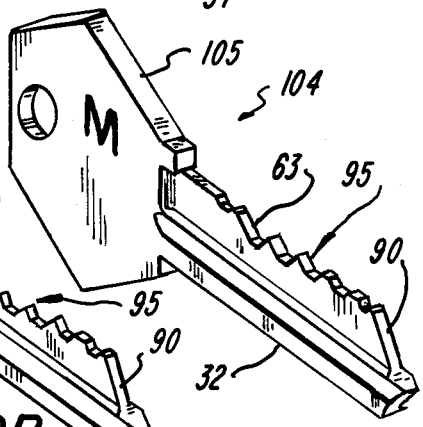
Figure 13:
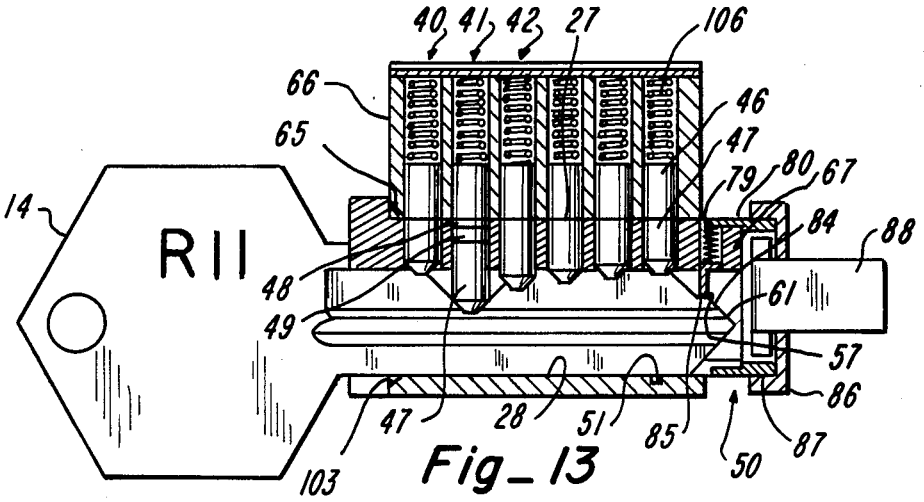
FIG. 13 is a partial vertical cross sectional view through the center of the lock showing a reset key inserted into the lock and shown full bodied.
Figure 14:
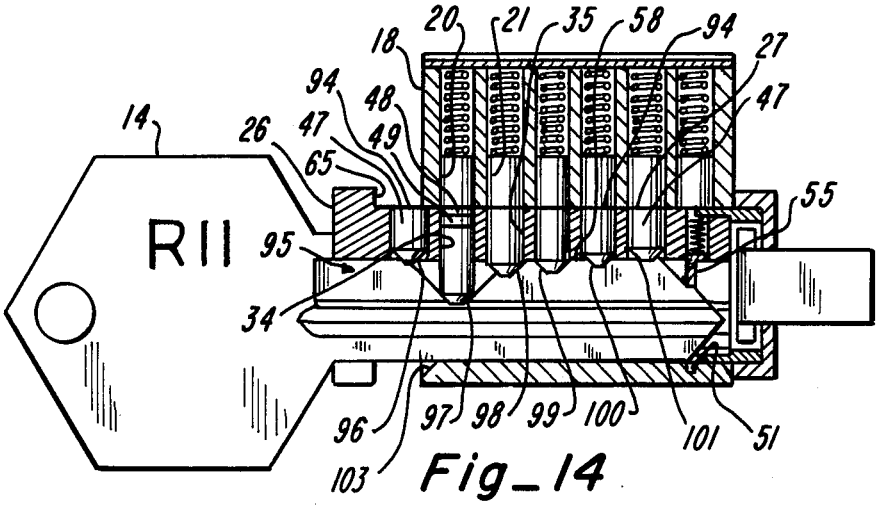
FIG. 14 is a partial vertical cross sectional view through the center of the lock showing the reset key inserted into the lock and the plug in the re-keying position.

Referring to FIGS. 9A, 13 and 14, the first reset key 14 is adapted for insertion into the keyway 28 and is bitted on its top side 58 for positioning the master pin 48 or both of the master pins 48 and 49, selectively above or below the shear interface 27 in the middle common pinway 41, for example. In FIGS. 13 and 14 the first reset key 14 is identified by the notation "R11" as a specific reset key 14 that positions both of the master pins 48 and 49 below the shear interface 27 to condition the master pin 48 for movement into the first common pinway 40. These identifications are set forth in detail in Table 2 below. A second reset key 59 (FIG. 9B) is provided for insertion into the keyway 28 and is bitted on its top side 60 for positioning the master pin 48 and 49 selectively above the shear interface 27 in the middle common pinway 41 to condition the master pin 48 for movement into the third common pinway 42. Thus, the selection of which of the first or second reset keys 14 and 59 that is to be used, and the resulting position of the master pins 48 and 49 relative to the shear interface 27, is dependent on whether one or both of the master pins 48 and 49 are to be transferred to the respective first or third common pinways 40 or 42.

As shown in FIGS. 13 through 16, the first reset key 14 and the first set key 15 are used to transfer the master pin 48 to the left, from the middle common pinway 41 to the first common pinway 40. Thus, the first reset key 14 is bitted on the top side 58 so that both of the master pins 48 and 49 are below the shear interface 27 when the plug 26 is in the first or rearward, normal position shown in FIG. 13 in which the lock 11 is operational. On the other hand, the second reset key 15 is bitted on the top side 60 so that the master pins 48 and 49 are above the shear interface 27 when the plug 26 is in the first longitudinal position.

Each of the first and second reset keys 14 and 59 has a leading edge 61 for cooperating with the cam follower 57 to move the retainer 55 out of the first groove 50 when the master pins 48 and 49 are selectively positioned by whichever one of the respective reset keys 14 or 59 is used. The plug 26 then slides forwardly into the second longitudinal position relative to the bore 17 so that the opposed top pinway portions 20 through 25 are no longer aligned with the respective bottom pinway portions 33 through 38. With the plug 26 in the second, forward position for re-keying, the retainer 55 moves into the second groove 51 to hold the plug 26 in the re-keying position.

Figure 15:
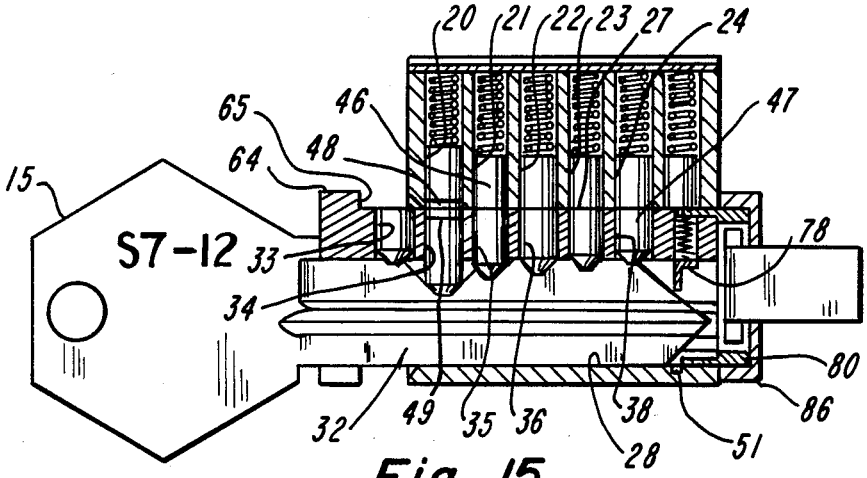
FIG. 15 is a partial vertical cross sectional view through the center of the lock showing the reset key removed and a selected set key shown full bodied inserted for re-keying the lock.

To complete the re-keying, after removal of the first reset key 14 from the keyway 28 the first set key 15 is inserted into the keyway 28 when the plug 26 is in the re-keying position (FIG. 15). The first set key 15 shown in FIG. 15 is identified by the notation "S7-12" as a specific set key 15 that is bitted for transferring only the master pin 48 from the bottom pinway portion 34 of the middle common pinway 41 into the top pinway portion 20 of the first common pinway 40. Also provided is a second set key 62 (FIG. 10B) adapted for insertion into the keyway 28 when the plug 26 is in the second longitudinal position. The second set key 62 is used in conjunction with the second reset key 59 and is bitted on a top side 63 for transferring the master pin 49 from the top pinway portion 21 of the middle common pinway 41 into the bottom pinway portion 35 of the third common pinway 42.

Figure 16:
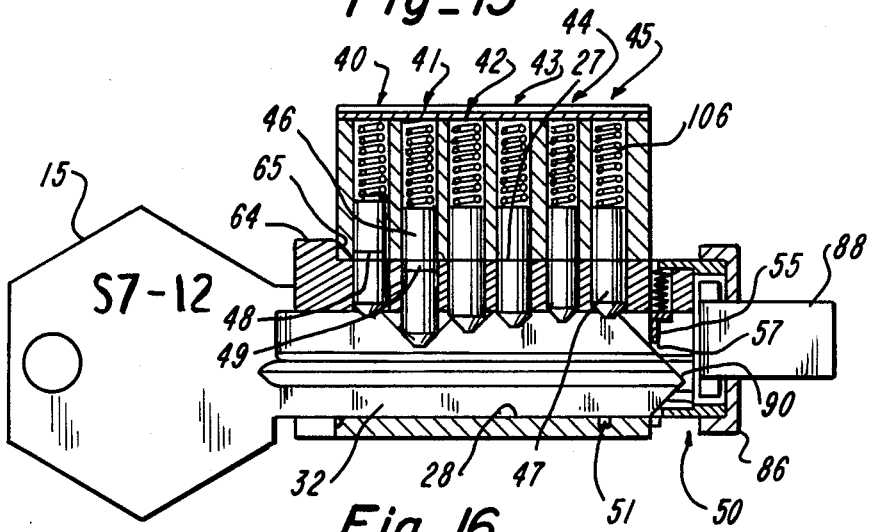
FIG. 16 is a partial vertical cross sectional view through the center of the lock showing the selected set key inserted in the lock and the plug moved back to the operational position after transposing the master pins for use with the next change key.
Figure 17:
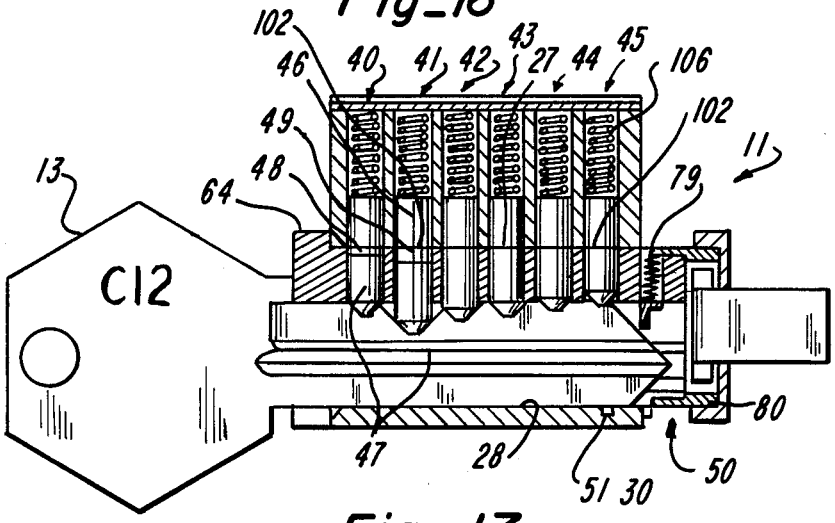
FIG. 17 is a partial vertical cross sectional view through the center of the lock showing the selected set key removed from the lock and the new change key inserted for operating the lock.

Each of the respective first and second set keys 15 and 62 is adapted for rotating the plug 26 to capture or retain the master pins 48 and 49 in the respective bottom and top pinway portions in which they are positioned. At the same time as the master pins are captured, the cam surface 54 (FIG. 7) of the arcuate groove 51 is effective upon rotation of the plug 26 to move the retainer 55 out of the groove 51 to allow the plug 26 to slide longitudinally and rearwardly into the bore 17 into the first position. As a result, the common pinways 40 through 45 are again formed and, as shown in FIGS. 16 and 17, the master pin 48 is in the first common pinway 40 and the master pin 49 is in the second common pinway 41 because the first reset key 14 and the first set key 15 were used.

When the second reset key 59 and the second set key 62 are used, and when the set key 62 is designated "M"

(FIG. 10C), the master pin 48 is transferred into the third common pinway 42. In both cases, the lock 11 is re-keyed for use with the second change key 13 (FIG. 17) that is adapted for use only when one or both of the master pins 48 and 49 are in the new common pinway location, "C12" indicating the second change key 13 used after the first reset key and set keys 14 and 15 respectively.

Figure 11:
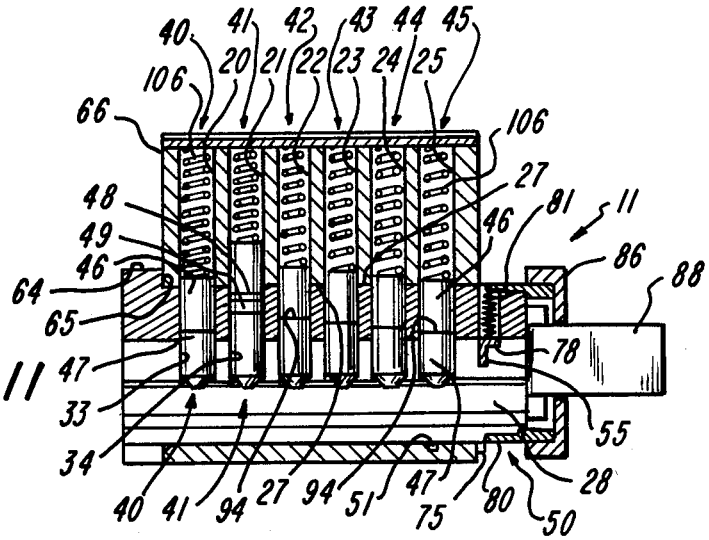
FIG. 11 is a partial vertical cross sectional view through the center of the assembled lock keyed for use with a selected change key, a selected sub-master key and the master key and with tumbler pins, two master pins, driver pins, springs and a tail-piece shown full bodied.
Figure 12:
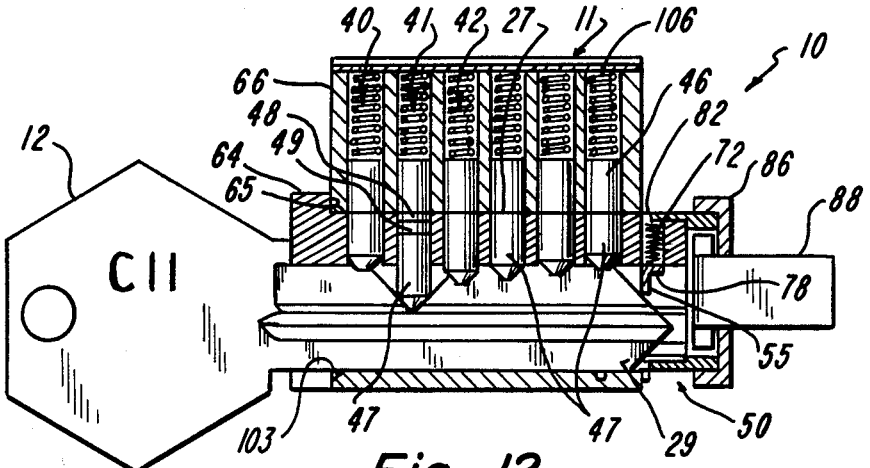
FIG. 12 is a partial vertical cross sectional view through the center of the lock showing the selected change key inserted into the lock and shown full bodied.

The method of the present invention is effective to re-key the lock 11 for use with successively different ones of a plurality of different change keys, such as the change keys 12 and 13, without disassembling the lock 11 or removing any parts therefrom. The method includes the steps of holding the plug 26 fixed axially in the first longitudinal position (FIG. 11) with the common pinways 40 through 45 formed. One or both of the master pins 48 and 49 are then selectively positioned. As shown in FIG. 12, both of the master pins 48 and 49 are positioned in the bottom pinway portion 34 (using the "R11" first reset key 14). The "R7-12" second reset key 59 could be used to position only the master pin 48 in the top pinway portion 21 to re-key for use of the "C10" change key 13. Whichever reset key is used, the plug 26 is then moved axially and the master pins 48 and 49 are moved across the shear interface 27 according to which of the first or second set keys 15 or 62, respectively, is used. Thus, if the first set key 15 is used, as shown in FIG. 15, for example, only the master pin 48 is transferred upwardly from the bottom pinway portion 34 across the shear interface 27 into the top pinway portion 20 of the first common pinway 40. If the "R7-12" second reset key 59 is used, the second set key 62 identified as "C10" is used and, for example, it transfers the second master pin 49 downwardly from the top pinway portion 21 of the middle common pinway 41 across the shear interface 27 into the bottom pinway portion 35 of the third common pinway 42.

In each case, by rotating the plug 26 the master pins 48 and 49 are retained in the new pinway so that by moving the plug 26 axially and rearwardly to align the pinway portions to form the first, second and third pinways 40, 41 and 42, the master pins 48 and 49 will be newly positioned in the respective first, second or third common pinways 40, 41 or 42. The lock 11 is thus re-keyed for use with the different change key 13.

Referring now to FIGS. 1 and 2, the lock 11 of the preferred embodiment of the present invention is shown including the plug 26 having a flange 64. FIGS. 11 through 13 show a rearwardly facing surface 65 of the flange 64 engaging a front face 66 of the housing 16 to limit longitudinal movement of the plug 26 into the bore 17. The position of the plug 26 shown in FIGS. 11 through 13 is the first longitudinal position. At an opposite or rearward end 67 of the plug 26 the retainer 55 is provided for releasably holding the plug 26 in the first longitudinal position. In particular, a slot or neck 68 is machined transversely across the plug 26 to receive the retainer 55. Referring also to FIG. 6, the slot 68 forms a shoulder 69 and spaced sides 70 and 71 depending therefrom. FIG. 6 also shows the keyway 28 extending through the slot 68 so that the leading edges 61 of the reset keys 14 and 59 can cooperate with the cam follower 57 of the retainer 55. A semi-circular groove 72 (FIG. 1) is machined on the rearward side of the slot 68 and extends partially across the plug 26.

The retainer 55 is fabricated from thin sheet metal to fit in the slot 68. Referring to FIG. 7, the cut 56 in the retainer 55 is wide enough so that legs 73 and 74 of the retainer 55 straddle the shoulder 69. The legs 73 and 74 extend downwardly along the respective sides 70 and 71 of the slot 68 so that the retainer 55 is movable transversely to the axis 52. The legs 73 and 74 of the retainer 55 extend close enough to the sides 70 and 71 so that when the plug 26 is rotated in the bore 17, the sides 70 and 71 engage the respective legs 73 and 74 and cause the retainer 55 to rotate with the plug 26.

As shown in FIGS. 5 and 7, depending ends 75 and 76 of the respective legs 73 and 74 extend into the external groove 50, transversely of and over the rear end 19 of the housing 16 when the retainer 55 is in a downward position with the plug 26 in the first, longitudinal rearward position.

As shown in FIG. 1, the retainer 55 is provided with a slot 77 and a tab 78 for receiving a coil spring 79 that is inserted into the semi-circular groove 72 in the plug 26. Referring also to FIG. 5, a stepped cylindrical sleeve 80 is mounted over a reduced diameter section 81 of the plug 26 to close the groove 72 enough to capture the coil spring 79 so that it acts on the tab 78 to urge the retainer 55 downwardly. The cam follower surface 57 is thus urged onto the shoulder 69 when no key is in the keyway 28.

Still referring to FIG. 5, a front end 82 of the sleeve 80 is spaced from an annular surface 87 (see FIG. 1 also) of the plug 26 to provide room for the retainer 55 to move upwardly under the action of one of the reset keys 14 and 59. In particular, in FIG. 13, the first reset key 14 is shown fully inserted into the keyway 28. The first reset key 14 has a section 83 shown in detail in FIG. 9A that is provided with a sloped or cam surface 84 extending from the leading edge 61 to a first bitting 85 that cooperates with the cam follower 57 of the retainer 55. The cam surface 84 is positioned longitudinally from the rear face 65 of the flange 64 of the plug 26 so that as the first reset key 14 is inserted into the keyway 28, the cam surface 84 rides under the cam follower 57 and urges the retainer 55 upwardly to compress the coil spring 79. As the retainer 55 moves upwardly, the lower ends 75 and 76 of the respective legs 73 and 74 move out of the exterior groove 50 and into the volume defined by the bore 17 so that they no longer extend across the rear end 19 of the housing 16 (FIG. 13).

As shown in FIG. 13, the cam follower 57 is supported by the bitting 85. Thus, the lower ends 75 and 76 are maintained out of the external groove 50. With the lower ends 75 and 76 out of the external groove 50, the plug 26 is free to slide longitudinally and forwardly partially out of the bore 17 with the first reset key 14 since the outer diameter of the sleeve 80 is slightly less than that of the bore 17. As shown in FIGS. 14 and 15, the sleeve 80 extends into the bore 17 far enough so that the sleeve 80 closes the top pinway portion 25 enough to prevent a master pin 48 that may be located therein from falling out of the top pinway portion 25. Thus, if the plug 26 is rotated 180° from the position shown in FIGS. 14 and 15, the sleeve 80 will prevent the master pin 48 or 49 from entering, tipping and being jammed in the keyway 28.

The movement of the plug 26 out of the bore 17 is limited by a hollow cap 86 (FIG. 1) that covers the rearward end 67 of the sleeve 80 to retain a tailpiece 88 that operates a bolt or latch (not shown) of the lock 11. A screw 89 threaded into the plug 26 secures the cap 86 to the sleeve 80.

As shown in FIGS. 14 and 15, when the bottom pinway portions 34 through 38 have been moved into alignment with their respective opposite, formerly adjacent top pinway portions 20 through 24, the retainer 55 is vertically aligned with the internal groove 51 that is formed in the bore 17. With the first reset key 14 fully in the keyway 28 (FIG. 14), the cam follower 57 is supported on the bitting 85 such that the plug 26 is free to move longitudinally in the bore 17. To prevent such movement, as the first reset key 14 is removed from the keyway 28, the cam follower 57 rides off the bitting 85 and moves downwardly onto the sloped cam surface 84 of the first reset key 14. As the cam follower 57 rides on the cam surface 84, the lower ends 75 and 76 of the respective legs 73 and 74 of the retainer 55 enter the second groove 51 (FIG. 7) and retain the plug 26 in the second longitudinal position. The opposed top and bottom pinway portions, such as the top portion 20 and the bottom portion 34 in which the master pins 48 and 49 are received when the "R11" first reset key 14 is used, are thus held aligned to allow selective transfer of one or more of the master pins 48 and 49 across the shear interface 27 to facilitate re-keying of the lock 11.

Still referring to FIG. 14, it may be appreciated that neither of the master pins 48 and 49 is positioned in the bottom pinway portion 33 just before the plug 26 is moved to the second re-keying position. This prevents the loss of the master pins 48 and 49 from the lock 11, which could occur since the bottom pinway portion 33 is not covered in the second re-keying position of the plug 26.

Referring now to FIGS. 15 and 16, it may be observed that the first set key 15 is fully inserted into the keyway 28 with a leading edge 90 just touching the cam follower 57 of the retainer 55. The leading edge 90 is shaped so that it does not cause the retainer 55 to move from its down or retaining position in which the lower ends 75 and 76 are received in the arcuate groove 51. Thus, as the first set key 15 selectively positions one or both of the master pins 48 and 49 in the respective top and bottom pinway portions 20 and 34 (FIG. 15), the plug 26 is releasably retained in the second longitudinal position.

Considering FIG. 7, the plug 26 is released by rotating the first reset key 15 either clockwise or counterclockwise, which correspondingly rotates the plug 26. In either event, the leading one of the lower ends 75 and 76 rides on the cam surface 54 of the groove 51 under the bias of the coil spring 79. Because the arcuate shape of the cam surface 54 is eccentric with respect to the bore 17, the depth of the groove 51 decreases as the cam surface 54 extends from a bottom 91 of the groove 51 to opposite ends 92 of the groove 51. Thus, as the leading one of the lower ends 75 and 76 rides on the plug 26 and the cam surface 54 moves either clockwise or counterclockwise, the retainer 55 is cammed upwardly out of the groove 51. When the plug 26 has been rotated about 90°, the ends 75 and 76 rest on the inner surface 93 of the bore 17 such that the plug 26 is free to move rearwardly and longitudinally in the bore 17 into the first longitudinal position. In FIG. 16 the plug 26 is shown in such position and rotated back to its original position to again form the common pinways 40 through 45. Further, the ends 75 and 76 of the retainer 55 have been moved by the coil spring 79 across the end 19 of the housing 16 into the groove 50 to retain the plug 26 in the first longitudinal position.

Referring now to FIG. 14, one of the tumbler pins 47 is shown received in each of the bottom pinway portions 33 through 38. While the tumbler pins 47 can have various heights (measured in the direction of the axis of the common pinways 40 through 45), the heights of the tumbler pins 47 of the preferred embodiments are selected as shown in Table 1; where the A station corresponds to the pinway portion 33 and the B through F stations correspond in sequence to the bottom pinway portions 34 through 38:

TABLE 1

| Tumbler Pin Heights | | | | | | |
|---|---|---|---|---|---|---|
| A | B | C | D | E | F | Station |
| 0 | 4 | 3 | 2 | 1 | 0 | Height |

As shown in FIG. 14, the first "R11" reset key 14 is provided with bittings 95 that are cut so that the tops 94 of the tumbler pins 47 are aligned with the shear interface 27. In particular, bittings 96 through 101 corresponding to the respective A through F stations are cut to correspond to the depths shown in Table 1, except for bitting 97 at station B which is cut to 9 depths to receive the 5 depths of the master pins 48 and 49.

Although the zero depth bitting 96 is shown in FIG. 14 as a full bitting depth (i.e. 15 thousandths of an inch), the zero depth bitting 96 is in practice cut only a few thousandths of an inch below the top 58 (FIG. 9A) of the first reset key 14, and seldom more than the normal clearance between the outer surface 39 (FIG. 1) of the plug 26 and the bore 17 of the housing 16. The top 94 of the A station tumbler pin 47 can thus rise a few thousandths of an inch above the surface 39 of the plug 26 when the plug is in its forwardly extended, second longitudinal position (FIG. 14) for re-keying and the first reset key 14 is withdrawn from the keyway 28. The front end 18 of the housing 16 is provided with a chamfer 103 around the bore 17. The chamfer 103 provides vertical clearance for the A station tumbler pin 47 to rise without falling out of the bottom pinway portion 33 when that tumbler pin 47 is moved upwardly by the top edge 58 of the first reset key 14 as such key is withdrawn from the keyway 28. Thus, an A station tumbler pin 47 having a depth of zero, one or two can be used and will rise 0.030 inch above the surface 39 of the plug 26 as the keys 15, for example, are inserted or withdrawn, and yet will not fall out when the plug 26 is rotated to release the retainer 55 from the second groove 51.

The first preferred embodiment of the lock apparatus 10 includes the above-described lock 11 in which the master pin 48 is a two-depth pin and the master pin 49 is a three-depth pin. This enables the lock 11 to be used with the sub-master keys. A sub-master key can be used with a selected number of different change keys 12 or 13, such as six in the first preferred embodiment. An example of a sub-master key for use with the first preferred embodiment of the lock 11 is the "S7-12" key 15 shown in FIG. 10A for use as the first set key 15.

The first embodiment of the lock 11 is used with a set 104 of keys that is specified in Table 2 below. The set 104 of keys and the lock 11 form the first embodiment of the lock apparatus 10 of the present invention.

Each key in the set 104 has a bit, such as the bits 29 and 30, adapted for insertion into the keyway 28. The set 104 of keys includes a master key 105 (FIG. 10C) identified as "M" in Table 2, reset keys 14 identified in Table 2 as "R" followed by a unique number and having various bittings 95 other than that of the master key 105, and a reset key 14 identified as "RM" in Table 2 and having the bittings 95 of the master key 105. Also, the set 104 includes thirty-six change keys, identified in Table 2 as "C" followed by a unique number. These change keys are represented in FIG. 12 as the first change key 12 and in FIG. 17 as the second change key 13.

TABLE 2

Description of Set 1Ø4 of Keys

| | Column 1 Master Pin Positions | | | | | | Column 2 Key Type | | Column 3 Key Bittings | | | | | | Column 4 Key Type | | | Column 5 Sub-Master |
|---|---|---|---|---|---|---|---|---|---|---|---|---|---|---|---|---|---|---|
| Row | A | B | C | D | E | F | and I.D. | | A | B | C | D | E | F | and I.D. | | Row | Keys |
| 1 | 2 | | | | | | | | | | | | | | | | | |
| | 3 | | | | | | CHANGE | C1 | 5 | 4 | 3 | 2 | 1 | Ø | CHANGE | C1 | 1 | S1–6 |
| 2 | | | | | | | RESET | RM | Ø | 4 | 3 | 2 | 1 | Ø | SET | M | | |
| | | 2 | | | | | SET | C11 | Ø | 9 | 3 | 2 | 1 | Ø | RESET | R11 | | |
| | | 3 | | | | | CHANGE | C11 | Ø | 9 | 3 | 2 | 1 | Ø | CHANGE | C11 | 2 | S7–12 |
| 3 | | | | | | | RESET | R7–12 | Ø | 7 | 3 | 2 | 1 | Ø | SET | S7–12 | | |
| | | | | | | | SET | M | Ø | 4 | 3 | 2 | 1 | Ø | RESET | RM | | |
| | 3 | 2 | | | | | CHANGE | C2 | 3 | 6 | 3 | 2 | 1 | Ø | CHANGE | C2 | 3 | S1–6 |
| 4 | | | | | | | RESET | RM | Ø | 4 | 3 | 2 | 1 | Ø | SET | M | | |
| | | | | | | | SET | S3 | Ø | 4 | 5 | 2 | 1 | Ø | RESET | R3 | | |
| | 3 | | 2 | | | | CHANGE | C3 | 3 | 4 | 5 | 2 | 1 | Ø | CHANGE | C3 | | |
| 5 | | | | | | | RESET | RM | Ø | 4 | 3 | 2 | 1 | Ø | SET | M | 4 | |
| | | | | | | | SET | S4 | Ø | 4 | 3 | 4 | 1 | Ø | RESET | R4 | | |
| | 3 | | | 2 | | | CHANGE | C4 | 3 | 4 | 3 | 4 | 1 | Ø | CHANGE | C4 | | |
| 6 | | | | | | | RESET | RM | Ø | 4 | 3 | 2 | 1 | Ø | SET | M | 5 | |
| | | | | | | | SET | S5 | Ø | 4 | 3 | 2 | 3 | Ø | RESET | R5 | | |
| | 3 | | | | 2 | | CHANGE | C5 | 3 | 4 | 3 | 2 | 3 | Ø | CHANGE | C5 | | |
| 7 | | | | | | | RESET | RM | Ø | 4 | 3 | 2 | 1 | Ø | SET | M | 6 | |
| | | | | | | | SET | S6 | Ø | 4 | 3 | 2 | 1 | 2 | RESET | R6 | | |
| | 3 | | | | | 2 | CHANGE | C6 | 3 | 4 | 3 | 2 | 1 | 2 | CHANGE | C6 | 7 | |
| 8 | | | | | | | RESET | RM | Ø | 4 | 3 | 2 | 1 | Ø | SET | M | 7 | |
| | | | | | | | SET | S7–12 | Ø | 7 | 3 | 2 | 1 | Ø | RESET | R7–12 | | |
| | | 3 | | | | 2 | CHANGE | C7 | Ø | 7 | 3 | 2 | 1 | 2 | CHANGE | C7 | 8 | S7–12 |
| 9 | | | | | | | RESET | R6 | Ø | 4 | 3 | 2 | 1 | 2 | SET | S6 | | |
| | | | | | | | SET | M | Ø | 4 | 3 | 2 | 1 | Ø | RESET | RM | | |
| | | 3 | | | 2 | | CHANGE | C8 | Ø | 7 | 3 | 2 | 3 | Ø | CHANGE | C8 | 9 | |
| 1Ø | | | | | | | RESET | R5 | Ø | 4 | 3 | 2 | 3 | Ø | SET | S5 | | |
| | | | | | | | SET | M | Ø | 4 | 3 | 2 | 1 | Ø | RESET | RM | | |
| | | 3 | | 2 | | | CHANGE | C9 | Ø | 7 | 3 | 4 | 1 | Ø | CHANGE | C9 | 1Ø | |
| 11 | | | | | | | RESET | R4 | Ø | 4 | 3 | 4 | 1 | Ø | SET | S4 | | |
| | | | | | | | SET | M | Ø | 4 | 3 | 2 | 1 | Ø | RESET | RM | | |
| | | 3 | 2 | | | | CHANGE | C1Ø | Ø | 7 | 5 | 2 | 1 | Ø | CHANGE | C1Ø | 11 | |
| 12 | | | | | | | RESET | R1Ø | Ø | 7 | 5 | 2 | 1 | Ø | SET | C1Ø | | |
| | | 2 | | | | | SET | S7–12 | Ø | 7 | 3 | 2 | 1 | Ø | RESET | R7–12 | | |
| | | 3 | | | | | CHANGE | C11 | Ø | 9 | 3 | 2 | 1 | Ø | CHANGE | C11 | 12 | |
| 13 | | | | | | | RESET | R11 | Ø | 9 | 3 | 2 | 1 | Ø | SET | C11 | | |
| | | | | | | | SET | S7–12 | Ø | 7 | 3 | 2 | 1 | Ø | RESET | R7–12 | | |
| | 2 | 3 | | | | | CHANGE | C12 | 2 | 7 | 3 | 2 | 1 | Ø | CHANGE | C12 | 13 | |
| 14 | | | | | | | RESET | RM | Ø | 4 | 3 | 2 | 1 | Ø | SET | M | | |
| | | | | | | | SET | S13–18 | Ø | 4 | 6 | 2 | 1 | Ø | RESET | R13–18 | | |
| | 2 | | 3 | | | | CHANGE | C13 | 2 | 4 | 6 | 2 | 1 | Ø | CHANGE | C13 | 14 | S13–18 |
| 15 | | | | | | | RESET | RM | Ø | 4 | 3 | 2 | 1 | Ø | SET | M | 14 | |
| | | | | | | | SET | S2 | Ø | 6 | 3 | 2 | 1 | Ø | RESET | R2 | | |
| | | 2 | 3 | | | | CHANGE | C14 | Ø | 6 | 6 | 2 | 1 | Ø | CHANGE | C14 | | |
| 16 | | | | | | | RESET | R13–18 | Ø | 4 | 6 | 2 | 1 | Ø | SET | S13–18 | 15 | |
| | | | 2 | | | | SET | C15 | Ø | 4 | 8 | 2 | 1 | Ø | RESET | R15 | | |
| | | | 3 | | | | CHANGE | C15 | Ø | 4 | 8 | 2 | 1 | Ø | CHANGE | C15 | 16 | |
| 17 | | | | | | | RESET | R13–18 | Ø | 4 | 6 | 2 | 1 | Ø | SET | S13–18 | | |
| | | | | | | | SET | C16 | Ø | 4 | 6 | 4 | 1 | Ø | RESET | R16 | | |
| | | | 3 | 2 | | | CHANGE | C16 | Ø | 4 | 6 | 4 | 1 | Ø | CHANGE | C16 | | |
| 18 | | | | | | | RESET | RM | Ø | 4 | 3 | 2 | 1 | Ø | SET | M | 17 | |
| | | | | | | | SET | S5 | Ø | 4 | 3 | 2 | 3 | Ø | RESET | R5 | | |
| | | | 3 | | 2 | | CHANGE | C17 | Ø | 4 | 6 | 2 | 3 | Ø | CHANGE | C17 | | |
| 19 | | | | | | | RESET | RM | Ø | 4 | 3 | 2 | 1 | Ø | SET | M | 18 | |
| | | | | | | | SET | S6 | Ø | 4 | 3 | 2 | 1 | 2 | RESET | R6 | | |
| | | | 3 | | | 2 | CHANGE | C18 | Ø | 4 | 6 | 2 | 1 | 2 | CHANGE | C18 | 19 | |
| 2Ø | | | | | | | RESET | RM | Ø | 4 | 3 | 2 | 1 | Ø | SET | M | | |
| | | | | | | | SET | S19–24 | Ø | 4 | 3 | 5 | 1 | Ø | RESET | R19–24 | | |
| | | | | 3 | | 2 | CHANGE | C19 | Ø | 4 | 3 | 5 | 1 | 2 | CHANGE | C19 | 2Ø | S19–24 |
| 21 | | | | | | | RESET | R6 | Ø | 4 | 3 | 2 | 1 | 2 | SET | S6 | | |
| | | | | | | | SET | M | Ø | 4 | 3 | 2 | 1 | Ø | RESET | RM | | |
| | | | | 3 | 2 | | CHANGE | C2Ø | Ø | 4 | 3 | 5 | 3 | Ø | CHANGE | C2Ø | 21 | |
| 22 | | | | | | | RESET | R2Ø | Ø | 4 | 3 | 5 | 3 | Ø | SET | C2Ø | 21 | |
| | | | | 2 | | | SET | S19–24 | Ø | 4 | 3 | 5 | 1 | Ø | RESET | R19–24 | | |
| | | | | 3 | | | CHANGE | C21 | Ø | 4 | 3 | 7 | 1 | Ø | CHANGE | C21 | 22 | |
| 23 | | | | | | | RESET | R21 | Ø | 4 | 3 | 7 | 1 | Ø | SET | C21 | | |
| | | | | | | | SET | S19–24 | Ø | 4 | 3 | 5 | 1 | Ø | RESET | R19–24 | | |
| | | | 2 | 3 | | | CHANGE | C22 | Ø | 4 | 5 | 5 | 1 | Ø | CHANGE | C22 | 23 | |
| 24 | | | | | | | RESET | R3 | Ø | 4 | 5 | 2 | 1 | Ø | SET | S3 | | |
| | | | | | | | SET | M | Ø | 4 | 3 | 2 | 1 | Ø | RESET | RM | | |
| | | 2 | | 3 | | | CHANGE | C23 | Ø | 6 | 3 | 5 | 1 | Ø | CHANGE | C23 | 24 | |
| 25 | | | | | | | RESET | R2 | Ø | 6 | 3 | 2 | 1 | Ø | SET | S2 | | |
| | | | | | | | SET | M | Ø | 4 | 3 | 2 | 1 | Ø | RESET | RM | | |

TABLE 2-continued

Description of Set 1Ø4 of Keys

| Row | Column 1 Master Pin Positions A | B | C | D | E | F | Column 2 Key Type and I.D. | | Column 3 Key Bittings A | B | C | D | E | F | Column 4 Key Type and I.D. | | Row | Column 5 Sub-Master Keys |
|---|---|---|---|---|---|---|---|---|---|---|---|---|---|---|---|---|---|---|
| | 2 | | | 3 | | | CHANGE | C24 | 2 | 4 | 3 | 5 | 1 | Ø | CHANGE | C24 | 25 | |
| 26 | | | | | | | RESET | RM | Ø | 4 | 3 | 2 | 1 | Ø | SET | M | | |
| | | | | | | | SET | S25-3Ø | Ø | 4 | 3 | 2 | 4 | Ø | RESET | R25-3Ø | | |
| | 2 | | | | 3 | | CHANGE | C25 | 2 | 4 | 3 | 2 | 4 | Ø | CHANGE | C25 | 26 | S25-3Ø |
| 27 | | | | | | | RESET | RM | Ø | 4 | 3 | 2 | 1 | Ø | SET | M | | |
| | | | | | | | SET | S2 | Ø | 6 | 3 | 2 | 1 | Ø | RESET | R2 | | |
| | | 2 | | | 3 | | CHANGE | C26 | Ø | 6 | 3 | 2 | 4 | Ø | CHANGE | C26 | 27 | |
| 28 | | | | | | | RESET | RM | Ø | 4 | 3 | 2 | 1 | Ø | SET | M | | |
| | | | | | | | SET | S3 | Ø | 4 | 5 | 2 | 1 | Ø | RESET | R3 | | |
| | | | 2 | | 3 | | CHANGE | C27 | Ø | 4 | 5 | 2 | 4 | Ø | CHANGE | C27 | 28 | |
| 29 | | | | | | | RESET | RM | Ø | 4 | 3 | 2 | 1 | Ø | SET | M | 28 | |
| | | | | | | | SET | S4 | Ø | 4 | 3 | 4 | 1 | Ø | RESET | R4 | | |
| | | | | 2 | 3 | | CHANGE | C28 | Ø | 4 | 3 | 4 | 4 | Ø | CHANGE | C28 | 29 | |
| 3Ø | | | | | | | RESET | R25-3Ø | Ø | 4 | 3 | 2 | 4 | Ø | SET | S25-3Ø | | |
| | | | | | 2 | | SET | C29 | Ø | 4 | 3 | 2 | 6 | Ø | RESET | R29 | | |
| | | | | | 3 | | CHANGE | C29 | Ø | 4 | 3 | 2 | 6 | Ø | CHANGE | C29 | 3Ø | |
| 31 | | | | | | | RESET | R25-3Ø | Ø | 4 | 3 | 2 | 4 | Ø | SET | S25-3Ø | | |
| | | | | | | | SET | C3Ø | Ø | 4 | 3 | 2 | 4 | 2 | RESET | R3Ø | | |
| | | | | | 3 | 2 | CHANGE | C3Ø | Ø | 4 | 3 | 2 | 4 | 2 | CHANGE | C3Ø | 31 | |
| 32 | | | | | | | RESET | RM | Ø | 4 | 3 | 2 | 1 | Ø | SET | M | | |
| | | | | | | 2 | SET | S31-36 | Ø | 4 | 3 | 2 | 1 | 3 | RESET | R31-36 | | |
| | | | | | | 3 | CHANGE | C31 | Ø | 4 | 3 | 2 | 1 | 5 | CHANGE | C31 | 32 | S31-36 |
| 33 | | | | | | | RESET | R31 | Ø | 4 | 3 | 2 | 1 | 5 | SET | C31 | | |
| | | | | | | | SET | S31-36 | Ø | 4 | 3 | 2 | 1 | 3 | RESET | R31-36 | | |
| | | | | | 2 | 3 | CHANGE | C32 | Ø | 4 | 3 | 2 | 3 | 3 | CHANGE | C32 | 33 | |
| 34 | | | | | | | RESET | R5 | Ø | 4 | 3 | 2 | 3 | Ø | SET | S5 | | |
| | | | | | | | SET | M | Ø | 4 | 3 | 2 | 1 | Ø | RESET | RM | | |
| | | | | 2 | | 3 | CHANGE | C33 | Ø | 4 | 3 | 4 | 1 | 3 | CHANGE | C33 | 34 | |
| 35 | | | | | | | RESET | R4 | Ø | 4 | 3 | 4 | 1 | Ø | SET | S4 | | |
| | | | | | | | SET | M | Ø | 4 | 3 | 2 | 1 | Ø | RESET | RM | | |
| | | | 2 | | | 3 | CHANGE | C34 | Ø | 4 | 5 | 2 | 1 | 3 | CHANGE | C34 | 35 | |
| 36 | | | | | | | RESET | R3 | Ø | 4 | 5 | 2 | 1 | Ø | SET | S3 | 35 | |
| | | | | | | | SET | M | Ø | 4 | 3 | 2 | 1 | Ø | RESET | RM | | |
| | | 2 | | | | 3 | CHANGE | C35 | Ø | 6 | 3 | 2 | 1 | 3 | CHANGE | C35 | 36 | |
| 37 | | | | | | | RESET | R2 | Ø | 6 | 3 | 2 | 1 | Ø | SET | S2 | | |
| | | | | | | | SET | M | Ø | 4 | 3 | 2 | 1 | Ø | RESET | RM | | |
| | 2 | | | | | 3 | CHANGE | C36 | 2 | 4 | 3 | 2 | 1 | 3 | CHANGE | C36 | 37 | |

The master key 105 has bittings 95 that enable the master key 105 to operate the lock 11 when it is keyed for operation by any one the thirty-six "C1" through "C36" change keys 12 or 13. In particular, the master key 105 positions both of the master pins 48 and 49 above the shear interface 27 to operate the lock 11 regardless of the station(s) at which the master pins 48 and 49 are located.

The set 104 of keys also includes sub-master keys designated in Column 5 of Table 2 as "S" followed by two numbers, e.g. "S7-12". Such designation indicates that such sub-master key is used to operate all of the locks 11 that the "C7" through "C12" change keys 12 and 13 can operate. The set 104 also includes set keys identified in Table 2 as "S" followed by a unique number, e.g. "S3".

Each of the sub-master keys 15, identified in Table 2 as "S1-6", "S7-12", "S13-18", "S19-24", "S25-30", and "S31-36", operates the lock 11 when the lock is keyed for operation by the respective "C1-6", "C7-12", "C13-18", "C19-24", "C25-30" and "C31-36" as change keys 12 and 13. In particular, the bittings 95 of the sub-master keys 15 are cut so that the master pin 48 is always positioned above the shear interface 27 and the master pin 49 is always positioned below the shear interface 27 when any one of the sub-master keys is used.

The set keys 15 and 62 and the "R" and "RM" reset keys 14 and 59, and the master key 105 are provided with bittings 95 as indicated in Table 2 for selectively locating one or both of the master pins 48 and 49 above or below the shear interface 27 as necessary to re-key the lock 11 from the current (or first) change key 12 to the next (or second) change key 13.

Referring to FIGS. 11 through 17 and to Table 2, it is observed in FIG. 11 that the master pins 48 and 49 are in the middle common pinway 41 and that no key is in the keyway 28. A compression spring 106 in each common pinway 40 through 45 urges the driver pins 46, the tumbler pins 47 and master pins 48 and 49 downwardly.

If the lock operator does not know the change key 12 or 13 for which the lock 11 is set, the "S1-7" through "S31-36" sub-master keys 15 can be successively inserted into the keyway 28 until one operates the lock. Then the change keys 12 corresponding to that sub-master key 15 are successively inserted into the keyway 28 until the change key 12 that operates the lock 11 is identified. Reference then to Table 2 indicates what keys of the set 104 of keys are required to re-key the lock 11.

Referring to Table 2, since the middle common pinway 41 is the B station, Table 2 indicates that the lock 11 shown in FIG. 11 is set for the "C11" first change key 12. This is shown in Row 2, which represents the only instance in which the sequence of re-keying the lock 11 from Row to Row does not progress directly to the next sequentially numbered change key 12. Thus, the "C11" change key 12 also appears in Row 12 of Table 2.

Table 2 indicates that to re-key the lock 11 for use with the second change key 13 having the next higher change key number (i.e. "C12"), the keys shown in Column 2—Row 13 are used, whereas to re-key for use with the next lower "C10" change key 13 the keys shown in Column 4—Row 11 are used. It is understood then, that the first preferred embodiment of the lock apparatus 10 of the present invention includes the lock 11 and the set 104 of keys that is specified in Table 2.

A first preferred embodiment of the method of the present invention can be performed using the set 104 of keys with the lock 11. This method selectively uses a plurality of the change keys 12 and 13 that are numbered in sequence from "C1" to "C36", where only one of a given one of such change keys 12 and 13 operates the lock 11 for a given lock setting. Also, the lock 11 is not disassembled nor are parts added to nor removed therefrom to facilitate such re-keying. The method is effective to re-key the lock 11 for successive use of such change keys 12 and 13 in the sequence or reverse sequence in which the change keys are numbered. The method includes the steps of providing the reset keys 14 and 59 having bittings 95 and identifications as specified in Column 3 of Table 2. Also provided, are set keys 15 and 62 having bittings 95 and identifications as provided in Column 3 of Table 2. The method includes the further step of initially providing a three-depth master pin 49 and a two-depth master pin 48 in the pinway 40 at station A as shown in Column 1, Row 1 of Table 2 to key the lock 11 for use only by the "C1" change key 12. The lock 11 is then re-keyed for successive use of the "C2" through "C36" change keys 12 and 13 by successively inserting into the keyway 28 the reset keys 14 and 59 identified in Column 2 at the Row (Row 2) following the Row (Row 1) in which the current "C1" change key 12 is listed. Then the set key 15 or 62 identified in such Row (Row 2) is selected. The insertion of each such reset key 14 or 59 is followed by the step of retaining the reset key 14 or 59 in the keyway 28 while moving the plug 26 axially and partially out of the bore 17 into the re-keying position. Then, such reset key 14 or 59 is removed from the keyway 28. Upon removal of the reset key 14 or 59 from the keyway 28, the selected set key 15 or 62 is inserted into the keyway 28 and rotated to rotate the plug 26. Next, the plug 26 is moved to the right to move it into the bore 17 into the first longitudinal, operational position. Finally, the set key 15 or 62 is removed from the keyway 28 to complete the re-keying for the next successive change key, which in this example would be "C11" change key 13.

Alternatively, the lock 11 could be re-keyed in reverse order, starting with the ∓C36" change key 12. The master pin 48 would be placed at the A station and the master pin 49 would be placed at the F station. Column 4 of Table 3 would be consulted from the bottom to the top to guide the re-keying of the lock 11.

Referring now to FIGS. 11 through 17, a series of steps in the first preferred method of the present invention re-key the lock 11 from use with the "C11" change key 12 to the "C12" change key 13. With no key in the keyway 28, the lock 11 appears as shown in FIG. 11 when the method is started. The lock 11 is to be conditioned for operation using the "C12" first change key 12 since the master pin 48 is transposed or transferred to the left (see Column 1, Row 13 of Table 2). The "C11" change key 12 has bittings of 093210 as shown in Column 3, Row 12 of Table 2.

TABLE 3

Description of Set 11Ø of Keys

| | Column 1 Master Pin Positions | | | | | | Column 2 Key Type and I.D. | | Column 3 Key Bittings | | | | | | Column 4 Key Type and I.D. | | |
|---|---|---|---|---|---|---|---|---|---|---|---|---|---|---|---|---|---|
| Row | A | B | C | D | E | F | | | A | B | C | D | E | F | | | Row |
| 1 | 2 | | | | | | | | | | | | | | | | |
| | 2 | | | | | | CHANGE | C1 | 4 | 4 | 3 | 2 | 1 | Ø | CHANGE | C1 | 1 |
| 2 | | | | | | | RESET | RM | Ø | 4 | 3 | 2 | 1 | Ø | SET | M | |
| | | | | | | | SET | S2 | Ø | 6 | 3 | 2 | 1 | Ø | RESET | R2 | |
| | 2 | 2 | | | | | CHANGE | C2 | 2 | 6 | 3 | 2 | 1 | Ø | CHANGE | C2 | 2 |
| 3 | | | | | | | RESET | RM | Ø | 4 | 3 | 2 | 1 | Ø | SET | M | |
| | | | | | | | SET | S3 | Ø | 4 | 5 | 2 | 1 | Ø | RESET | R3 | |
| | 2 | | 2 | | | | CHANGE | C3 | 2 | 4 | 5 | 2 | 1 | Ø | CHANGE | C3 | 3 |
| 4 | | | | | | | RESET | RM | Ø | 4 | 3 | 2 | 1 | Ø | SET | M | |
| | | | | | | | SET | S4 | Ø | 4 | 3 | 4 | 1 | Ø | RESET | R4 | |
| | 2 | | | 2 | | | CHANGE | C4 | 2 | 4 | 3 | 4 | 1 | Ø | CHANGE | C4 | 4 |
| 5 | | | | | | | RESET | RM | Ø | 4 | 3 | 2 | 1 | Ø | SET | M | |
| | | | | | | | SET | S5 | Ø | 4 | 3 | 2 | 3 | Ø | RESET | R5 | |
| | 2 | | | | 2 | | CHANGE | C5 | 2 | 4 | 3 | 2 | 3 | Ø | CHANGE | C5 | 5 |
| 6 | | | | | | | RESET | RM | Ø | 4 | 3 | 2 | 1 | Ø | SET | M | |
| | | | | | | | SET | S6 | Ø | 4 | 3 | 2 | 1 | 2 | RESET | R6 | |
| | 2 | | | | | 2 | CHANGE | C6 | 2 | 4 | 3 | 2 | 1 | 2 | CHANGE | C6 | 6 |
| 7 | | | | | | | RESET | RM | Ø | 4 | 3 | 2 | 1 | Ø | SET | M | |
| | | | | | | | SET | S2 | Ø | 6 | 3 | 2 | 1 | Ø | RESET | R2 | |
| | | 2 | | | | 2 | CHANGE | C7 | Ø | 6 | 3 | 2 | 1 | 2 | CHANGE | C7 | 7 |
| 8 | | | | | | | RESET | R6 | Ø | 4 | 3 | 2 | 1 | 2 | SET | S6 | 7 |
| | | | | | | | SET | M | Ø | 4 | 3 | 2 | 1 | Ø | RESET | RM | |
| | | 2 | | | 2 | | CHANGE | C8 | Ø | 6 | 3 | 2 | 3 | Ø | CHANGE | C8 | 8 |
| 9 | | | | | | | RESET | R5 | Ø | 4 | 3 | 2 | 3 | Ø | SET | S5 | |
| | | | | | | | SET | M | Ø | 4 | 3 | 2 | 1 | Ø | RESET | RM | |
| | | 2 | | 2 | | | CHANGE | C9 | Ø | 6 | 3 | 4 | 1 | Ø | CHANGE | C9 | 9 |
| 1Ø | | | | | | | RESET | R4 | Ø | 4 | 3 | 4 | 1 | Ø | SET | S4 | |
| | | | | | | | SET | M | Ø | 4 | 3 | 2 | 1 | Ø | RESET | RM | |
| | | 2 | 2 | | | | CHANGE | C1Ø | Ø | 6 | 5 | 2 | 1 | Ø | CHANGE | C1Ø | 1Ø |
| 11 | | | | | | | RESET | R3 | Ø | 4 | 5 | 2 | 1 | Ø | SET | S3 | |
| | | 2 | | | | | SET | M | Ø | 4 | 3 | 2 | 1 | Ø | RESET | RM | |
| | | 2 | | | | | CHANGE | C11 | Ø | 8 | 3 | 2 | 1 | Ø | CHANGE | C11 | 11 |
| 12 | | | | | | | RESET | RM | Ø | 4 | 3 | 2 | 1 | Ø | SET | M | |
| | | | 2 | | | | SET | C12 | Ø | 4 | 7 | 2 | 1 | Ø | RESET | R12 | |

TABLE 3-continued

| Row | Column 1 Master Pin Positions A | B | C | D | E | F | Column 2 Key Type and I.D. | | Column 3 Key Bittings A | B | C | D | E | F | Column 4 Key Type and I.D. | | Row |
|---|---|---|---|---|---|---|---|---|---|---|---|---|---|---|---|---|---|
| | | | 2 | | | | CHANGE | C12 | Ø | 4 | 7 | 2 | 1 | Ø | CHANGE | C12 | 12 |
| 13 | | | | | | | RESET | RM | Ø | 4 | 3 | 2 | 1 | Ø | SET | M | |
| | | | | | | | SET | S4 | Ø | 4 | 3 | 4 | 1 | Ø | RESET | R4 | |
| | | | 2 | 2 | | | CHANGE | C13 | Ø | 4 | 5 | 4 | 1 | Ø | CHANGE | C13 | 13 |
| 14 | | | | | | | RESET | RM | Ø | 4 | 3 | 2 | 1 | Ø | SET | M | |
| | | | | | | | SET | S5 | Ø | 4 | 3 | 2 | 3 | Ø | RESET | R5 | |
| | | | 2 | | 2 | | CHANGE | C14 | Ø | 4 | 5 | 2 | 3 | Ø | CHANGE | C14 | |
| 15 | | | | | | | RESET | RM | Ø | 4 | 3 | 2 | 1 | Ø | SET | M | 14 |
| | | | | | | | SET | S6 | Ø | 4 | 3 | 2 | 1 | 2 | RESET | R6 | |
| | | | 2 | | | 2 | CHANGE | C15 | Ø | 4 | 5 | 2 | 1 | 2 | CHANGE | C15 | 15 |
| 16 | | | | | | | RESET | RM | Ø | 4 | 3 | 2 | 1 | Ø | SET | M | |
| | | | | | | | SET | S4 | Ø | 4 | 3 | 4 | 1 | Ø | RESET | R4 | |
| | | | | 2 | | 2 | CHANGE | C16 | Ø | 4 | 3 | 4 | 1 | 2 | CHANGE | C16 | 16 |
| 17 | | | | | | | RESET | R6 | Ø | 4 | 3 | 2 | 1 | 2 | SET | S6 | |
| | | | | | | | SET | M | Ø | 4 | 3 | 2 | 1 | Ø | RESET | RM | |
| | | | | 2 | 2 | | CHANGE | C17 | Ø | 4 | 3 | 4 | 3 | Ø | CHANGE | C17 | 17 |
| 18 | | | | | | | RESET | R5 | Ø | 4 | 3 | 2 | 3 | Ø | SET | S5 | |
| | | | | 2 | | | SET | M | Ø | 4 | 3 | 2 | 1 | Ø | RESET | M | |
| | | | | 2 | | | CHANGE | C18 | Ø | 4 | 3 | 6 | 1 | Ø | CHANGE | C18 | 18 |
| 19 | | | | | | | RESET | RM | Ø | 4 | 3 | 2 | 1 | Ø | SET | M | |
| | | | | | 2 | | SET | C19 | Ø | 4 | 3 | 2 | 5 | Ø | RESET | R19 | |
| | | | | | 2 | | CHANGE | C19 | Ø | 4 | 3 | 2 | 5 | Ø | CHANGE | C19 | 19 |
| 2Ø | | | | | | | RESET | RM | Ø | 4 | 3 | 2 | 1 | Ø | SET | M | |
| | | | | | | | SET | S6 | Ø | 4 | 3 | 2 | 1 | 2 | RESET | R6 | |
| | | | | | 2 | 2 | CHANGE | C2Ø | Ø | 4 | 3 | 2 | 3 | 2 | CHANGE | C2Ø | 2Ø |
| 21 | | | | | | | RESET | RM | Ø | 4 | 3 | 2 | 1 | Ø | SET | M | |
| | | | | | | 2 | SET | S6 | Ø | 4 | 3 | 2 | 1 | 2 | RESET | R6 | |
| | | | | | | 2 | CHANGE | C21 | Ø | 4 | 3 | 2 | 1 | 4 | CHANGE | C21 | 21 |

According to Columns 2 and 3, Row 13 of Table 2, the "R11" reset key 14 is to be selected and has bittings 95 of 093210 as shown in FIG. 13. The "R11" reset key 14 is inserted into the keyway 28 and is effective to position both master pins 48 and 49 below the shear interface 27 at station B. Also, the cam surface 84 urges the cam follower 57 up in the slot 68 as the ∓R11" reset key 14 moves fully into the keyway 28. The lower ends 75 and 76 of the retainer 55 thus move out of the external groove 50 and the cam follower 57 is supported on the bitting 85 as shown in FIG. 13.

The plug 26 and the ∓R11" first reset key 14 are then moved forwardly (to the left in FIG. 14) to partially remove the plug 26 from the bore 17 and move the plug 26 into the second longitudinal position shown in FIG. 14. The coil spring 79 is shown effective to urge the lower ends 73 and 74 of the retainer 55 into the internal groove 51 of the bore 17 to retain the plug 26 in the second longitudinal position. The bottom pinway portion 34 carrying the master pins 48 and 49 is aligned with the A station top pinway portion 20.

The "R11" first reset key 14 is then removed from the keyway 28. The first set key 15 is selected from Column 2, Row 13 of Table 2 as that designated "S7-12" having bittings 95 of 073210. Such "S7-12" first set key 15 is inserted into the keyway 28 and, as shown in FIG. 15, moves only the top, two-depth master pin 48 across the shear interface 27 into the top pinway portion 20 at the A station. Since the B station of the "S7-12" set key 15 has a depth of 7, the bottom master pin 49 remains in the bottom pinway portion 34 of the B station of the plug 26.

The "S7-12" set key 15 is then rotated clockwise or counterclockwise to rotate the plug 26 correspondingly, leaving the two-depth top master pin 48 in the top pinway portion 20. The rotation of the plug 26 causes the lower ends 75 and 76 of the retainer 55 to ride on the cam surface 54 and out of the internal groove 51 onto the inner surface 94 of the bore 17 (FIG. 7). The plug 26 and the "S7-12" first set key 15 are then moved to the right (in FIG. 16) into the bore 17 to the second longitudinal or operational position. The plug 26 is then rotated back to its original position shown in FIG. 16. The two-depth top master pin 48 is at the A statin and the three-depth bottom master pin 49 is returned to its original B station as indicated at Column 1, Row 13 of Table 2. Thus, as shown in FIG. 17, the "C12" second change key 13 can now operate the lock 11 after the "R7-12" set key 15 is removed from the lock 11. As shown in FIG. 16, as the "R7-12" set key 15 is withdrawn from the keyway 28, the cam follower 57 rides off the bitting 85 onto the cam surface 84 under the action of the coil spring 79 so that the lower ends 75 and 76 of the retainer 55 extend into the external groove 50 and over the end 19 of the housing 16 to hold the plug 28 in operational position.

The "C12∞ second change key 13 has bittings 95 of 273210 as shown at Column 3, Row 13 in Table 2 so that the tops 102 of the tumbler pins 47 at stations C through F and the tops 102 of the master pins 48 and 49 at respective stations A and B are aligned with the shear interface 27 to permit operation of the lock 11.

Referring in more detail to Table 2, it may be observed that the first preferred method only requires a minimum of different keys to re-key and operate lock 11. For example, in Column 2—Row 2 of Table 2 the "C11" change key 12 functions both as a set key 14 and a change key 12. Also, the "R11" reset key 14 usable at Column 2, Row 13 for re-keying to the "C12" change key 13 is also usable at Column 4, Row 1 as the "R11" reset key 15 for re-keying from the "C11" change key 12 to the "C1" change key 13. Also, the "R3" reset key 14 is used at Row 3—Column 4, at Row 24—Column 2, at Row 27—Column 4 and at Row 36—Column 2, for example. Other examples of duplicate use of certain keys will be apparent from further review of Table 2.

As indicated, the method of the present invention enables the lock 11 to be re-keyed in the sequence in which the change keys 12 and 13 are numbered, either in order of increasing or decreasing numbers except for Row 2 where the "C11" change key 12 is used because of the required transposing of both master pins 48 and 49 to or from the A station. The key identifications listed in Table 2 are stamped or otherwise provided on the keys, such as "R11" for the reset key 14 shown in FIG. 9A and "S7-12" for the set key 15 shown in FIG. 10A, so that the particular keys for use in re-keying and operating the lock 11 may be easily selected.

Table 3 illustrates how the principles of the present invention can be applied in using a second preferred embodiment of the lock apparatus 10 of the present invention to perform a second preferred embodiment of the method of the present invention. In the second preferred embodiment a lock 107 (FIG. 18) is used without the sub-master keys 15. The lock 107 is the same as the lock 11 except for the master pins. In particular, the lock 107 is provided with two two-depth master pins 108 and 109. The second embodiment of the lock apparatus 10 includes the lock 107 and a set 110 of keys identified in Table 3. The lock 107 has six tumbler pins 47 of depths 043210 corresponding to stations A through F. Thus, with the master pins 108 and 109 being two-depth, for the "C2" change key 12 to unlock the lock 107, the bittings 95 for the station in which a master pin 108 is located must be cut to a depth equal to the sum of the height of the tumbler pin 47 and that of the two-depth master pin 108. For example, the "C7" change key 12 operates with master pins 108 and 109 in the respective B and F stations, such that the bittings 95 must be 063212, which is the sum of the 043210 tumbler pin heights and the 020002 depths of the tumbler pins 108 and 109.

The pins 108 and 109 are initially both in the A station if it is desired to re-key the lock 107 in numerical sequence from the "C1" through the "C21" change keys 12 and 13 identified in Table 3 using the second preferred embodiment of the method of the present invention. That is, with only one movement of the plug 26 from the operational position to the re-keying position and only one return movement of the plug 26 back to the operational position, each of the "C1" through "C21" change key re-keying operations may be accomplished. In particular, this method includes the steps of holding the plug 26 fixed axially with the first and second common pinways 40 and 41 formed. The master pins 108 and 109 are initially positioned in the first common pinway 40 above the shear interface 27. The plug 26 is moved axially to align the master pin 109 with the bottom pinway portion 34. The master pin 109 is then moved across the shear interface 27 into the bottom pinway portion 34. The plug 26 is rotated to capture the master pin 109 in the bottom pinway portion 34. The plug 26 is then moved axially into the bore 17 to complete the transfer with the master pin 108 in the first common pinway 40 and the master pin 109 in the second common pinway 41.

Referring in detail to Table 3, the same symbols are used to designate the various keys as are used in Table 2. That is, "M" designates the master key 105, "RM" designates a reset key 14 that is bitted as the master key 105, "C" followed by a number designates the change keys 12 and 13 and the reset keys 14 and 59 are designated "R" followed by a number. Also, "2" indicates the location of the master pins 108 and 109. The master key 105 identified in Table 3 has the same 043210 bittings 95 as are used in Table 2 since this arrangement causes the various keys to move the pins 46 and 47 upwardly as the keys are removed from the keyway 28.

Referring also to Table 4, for ease of description the stations A through F in the housing 16 and in the plug 26 of the lock 107 are identified separately.

TABLE 4

| Re-Keying From "C1" to "C2" | | |
|---|---|---|
| | Housing Stations | |
| | A B C D E F | |
| "C1" Change Key 12 | 2 | Shear Interface 27 |
| | 2 | |
| | A B C D E F | |
| | Plug Stations | |
| | Housing Stations | |
| | A B C D E F | |
| "RM" Reset Key 14 - Normal Position | 2 | |
| | 2 | Shear Interface 27 |
| | A B C D E F | |
| | Plug Stations | |
| | Housing Stations | |
| | A B C D E F | |
| "RM" Reset Key 14 - Re-keying Position | 2 | |
| | 2 | Shear Interface 27 |
| | A B C D E F | |
| | Plug Stations | |
| | Housing Stations | |
| "S2" Set Key 15 - Re-keying Position | A B C D E F | |
| | 2 | Shear Interface 27 |
| | 2 | |
| | A B C D E F | |
| | Plug Stations | |
| | Housing Stations | |
| "S2" Set Key 15 - Normal Position | A B C D E F | |
| | 2 | Shear Interface 27 |
| | 2 | |
| | A B C D E F | |
| | Plug Stations | |
| | Housing Stations | |
| "C2" Change Key 13 - Unlocked | A B C D E F | |
| | | Shear Interface 27 |
| | 2 2 | |
| | A B C D E F | |
| | Plug Stations | |

Figure 18:
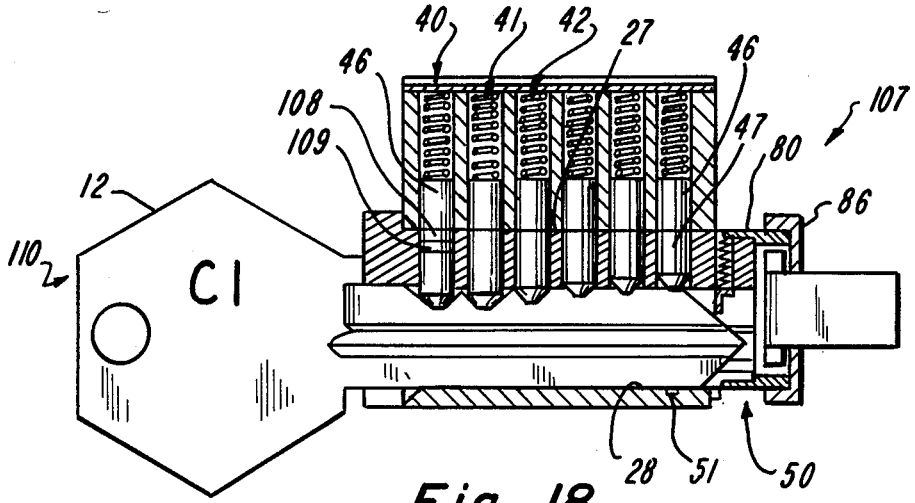
FIG. 18 is a partial vertical cross sectional view through the center of a second embodiment of the lock showing two, two-depth master pins, instead of one three-depth master pin and one two-depth master pin, for use without sub-master keys.

In accordance with Table 3, and as shown in FIG. 18, the two-depth master pins 108 and 109 are represented as being at the A station in the first common pinway 40 when the "C1" first change key 12 is used. Opposite the designation "RM reset key 14—normal position" in Table 4 the master pins 108 and 109 are indicated as being repositioned by the "RM" reset key 14 so that both the master pin 108 and the master pin 109 are above the shear interface 27. With the plug 26 unlocked and moved to the re-keying position ("RM reset key 14—re-keying position"), the housing station A is aligned with the plug station B to condition the master pin 109 that is in the housing station A for transfer across the shear interface 27 to the plug station B. With the housing station A aligned with the plug station B, the "RM" reset key 14 is removed from the keyway 28 and the "S2" set key 15 is inserted. The bittings 95 of the "S2" set key 15 are 063210, such that with the tumbler pins 47 having depths of 043210 the master pin 109 in the B plug station is positioned below the shear interface 27. Thus, the plug 26 can be returned to the operational position ready for the use of the "C2" change key 13. As indicated in Table 3, the "C2" change key 13 has bittings 95 of 263210 that position the master pins 108 and 109 below the shear interface 27 to permit operation of the lock 11.

While the preferred embodiments have been described in order to illustrate the fundamental relationships of the present invention, it should be understood that numerous variations and modifications may be made to these embodiments without departing from the teachings and concepts of the present invention. Accordingly, it should be clearly understood that the form of the present invention described above and shown in the accompanying drawings is illustrative only and is not intended to limit the scope of the invention to less than that described in the following claims.

What is claimed is:

1. In a lock for sequential exclusive use with first and second change keys and use with reset key means for re-keying said lock to render it usable with only one of said change keys, said lock including a housing having an inner end; a bore extending through said housing along a longitudinal axis to define a shear interface; a plug rotatably received in said bore and having a keyway extending therein along said axis; said housing and said plug having holes therein, said housing and said plug being normally positioned so that said holes form portions of and combine to form at least first and second pinways that are spaced in the axial direction; a first tumbler stack including a first tumbler pin, a first driver pin and at least one master pin being received in said first pinway; said master pin separating said first driver pin from said first tumbler pin; and a second tumbler stack in said second pinway and including a second driver pin and a second tumbler pin; the improvement comprising:

said plug being slidably received in said bore for movement from said normal axial position in which said holes form said first and second pinways to a temporary re-keying axial position in which a hole in said plug that normally forms said second pinway is axially displaced for alignment with a hole in said housing that normally forms said first pinway so that said master pin is transferrable into a different one of said pinways;

means rotatable in said bore with said plug and slidably mounted on said plug for releasably retaining said plug in said normal axial position, said retaining means having a central section intersecting said keyway, said retaining means having a retainer section extending from said central section transversely across said inner end of said housing for retaining said plug in said normal axial position, said central section being adapted to respond to said reset key means in said keyway to move said retainer section into said bore and release said plug for movement to said temporary re-keying axial position; and said bore having an arcuate slot formed therein transversely to said axial direction for receiving said retainer section of said retaining means to releasably retain said plug in said temporary re-keying axial position, said slot being formed eccentrically with respect to said arcuate section so that upon rotation of said plug said retainer section rides out of said slot to release said plug for return axial movement in said bore to said normal axial position and to allow said retainer section to extend transversely across said inner end of said housing for retaining said plug in said normal axial position, said return axial movement of said plug to said normal position being effective to recombine said holes and render said lock usable with only one of said first and second change keys according to the different pinway in which said master pin is received.

2. A lock apparatus including a lock and reset key means as recited in claim 1, wherein said lock apparatus further includes:

set key means for re-keying said lock;

holes are provided in said housing and said plug to form a third pinway on the side of said first pinway opposite from said second pinway;

said reset key means has a bitting to selectively locate said master pin in one of said hole in said plug and said hole in said housing of said first pinway when said retaining means is released so that upon said axial movement of said plug to said temporary re-keying axial position said master pin in said plug hole is moved into alignment with said third pinway and said master pin in said housing hole remains in said first pinway; and said set key means is adapted to slide into said keyway and is provided with a bitting for selectively transferring said master pin across said shear interface such that said master pin in said plug hole moves into said housing hole of said third pinway and said master pin in said housing hole moves into said plug hole of said second pinway, said set key means in said keyway being adapted to rotate said plug to capture said master pin in the respective plug hole of said second pinway or housing hole of said third pinway and to simultaneously ride said retainer section out of said arcuate slot to allow said plug to return to said normal axial position with said master pin at a new location in said second or third pinway so that said lock must be used with a different one of said change keys.

3. A lock apparatus as recited in claim 2, wherein:

said reset key means has a second bitting for supporting said central section of said retaining means so that said retainer section remains in said bore during movement of said plug to said temporary re-keying position.

4. In a lock for sequential exclusive use with first and second change keys and use with reset key means for re-keying said lock to render it usable with only one of said change keys, said lock including a housing having an inner end; a bore extending through said housing along a longitudinal axis to define a shear interface; a plug rotatably received in said bore and having a keyway extending therein along said axis; said housing and said plug having holes therein, said housing and said plug being normally positioned so that said holes form portions of and combine to form at least first and second pinways that are spaced in the axial direction; a first tumbler stack including a first tumbler pin, a first driver pin and at least one master pin being received in said first pinway; said master pin separating said first driver pin from said first tumbler pin; and a second tumbler stack in said second pinway and including a second driver pin and a second tumbler pin; the improvement comprising:

said plug being slidably received in said bore for movement from a normal axial position in which said aligned holes form said first and second pinways to a re-keying axial position in which a hole in said plug that normally forms said second pinway is axially displaced for alignment with a hole in said housing that normally forms said first pinway;

said plug having a flange on an outer end thereof to limit movement thereof into said bore;

means rotatable in said bore with said plug and slidably mounted on said plug for releasably retaining said plug in said normal axial position, said retaining means having a central section intersecting said keyway, said retaining means having a retainer section extending from said central section transversely across said inner end of said housing for retaining said plug in said normal axial position, said central section being adapted to respond to said reset key means in said keyway to move said retainer section into said bore and release said plug for movement to said re-keying axial position;

said plug also having an inner end adjacent said inner end of said housing and being provided with a neck extending vertically therein for receiving said retaining means so that said retainer section thereof extends across said inner end of said housing when said plug is in said normal axial position;

said bore having an arcuate slot formed therein transversely to said axial direction for receiving said retainer section of said retaining means to releasably retain said plug in said re-keying axial position, said slot being formed eccentrically with respect to said arcuate section so that upon rotation of said plug said retainer section rides out of said slot to release said plug for axial movement in said bore to said normal axial position and to allow said retainer section to extend transversely across said inner end of said housing for retaining said plug in said normal axial position; and resilient means for releasably biasing said retainer section into said arcuate slot when said plug is in said re-keying axial position and across said inner end of said housing when said plug is in said normal axial position.

5. A lock as recited in claim 4, wherein:

said neck forms a guideway having spaced sides connected by a shoulder; and said retaining means is in the form of a disk having a pair of legs that straddle said shoulder and extend along said sides to permit said disk to move relative to said plug transversely to said axis and to move with said plug upon rotation of said plug, said retainer section is formed at the periphery of each of said legs so that upon rotation of said plug in either the clockwise or counter-clockwise direction one of said retainer sections rides out of said eccentric slot to release said plug for axial movement back to said normal axial position.

6. A lock as recited in claim 4, wherein:

said inner end of said plug has a reduced diameter and is provided with a hole adjacent to said retaining means;

said resilient means is provided in said hole; and a sleeve is mounted over said inner end for holding said resilient means in said hole, said sleeve being movable with said plug into said bore to prevent said driver pin and master pin from falling out of said housing hole of said second pinway upon movement of said plug into said re-keying axial position.

7. In a re-keyable lock apparatus for use with different change keys having different bittings thereon; including a lock cylinder housing with a cylindrical bore extending longitudinally therethrough from a first end to a second end; longitudinally spaced, elongated top pinway portions in said housing extending perpendicular to and radially outward from said cylindrical bore; a cylindrical plug positioned rotatably in and defining a shear interface with said bore; said plug having a longitudinal keyway therein for receiving a key bit and having longitudinally spaced bottom pinway portions extending radially inward from the peripheral surface thereof into said keyway; opposite pairs of said bottom and top pinway portions being adapted to align with each other to form common first, middle and third pinways; a top tumbler pin and a bottom tumbler pin slidably positioned in each of said common pinways; said plug being rotatable when the interface between said top and bottom pins is aligned with said shear interface and not being rotatable when a pin is positioned across said shear interface; the improvement comprising:

master pin means adapted to be selectably positioned in any one of said common pinways for providing an additional interface between said top and bottom pins therein to align with said shear interface, the location of said master pin in different ones of said common pinways requiring the use of a different one of said change keys;

said housing being provided with a pair of grooves that are longitudinally spaced along said bore by the distance between said common pinways, a second one of said grooves being arcuate and eccentric with respect to said bore so that it extends into said bore for a limited distance along the circumference of said bore to form a cam surface;

retainer means carried by said plug for movement transverse thereto into a first of said grooves to hold said plug in a first longitudinal position relative to said bore so that said pinways are aligned to form said common pinways and into said second one of said grooves to hold said plug in a second longitudinal position relative to said bore so that said bottom and top pinways become aligned with respective opposite adjacent top and bottom pinway portions, said retainer means extending across said keyway and having a cut therein forming a cam follower for moving said retainer means out of said first of said grooves;

first reset key means adapted for insertion into said keyway and being bitted on one side for positioning said master pin means in said bottom pinway portion of said middle common pinway to condition said master pin for movement into said first common pinway;

second reset key means adapted for insertion into said keyway and being bitted on one side for positioning said master pin means in said top pinway portion of said middle common pinway to condition said master pin means for movement into said third common pinway;

each of said first and second reset key means having a leading edge provided with cam means for cooperating with said cam follower to move said retainer means out of said first groove when said master pin means is positioned by said respective reset key means and to slide said plug into said second longitudinal position relative to said bore so that said retainer means moves into said second groove to hold said plug in said second position;

first set key means adapted for insertion into said keyway when said plug is in said second longitudinal position and being bitted for transferring said master pin means from said bottom pinway portion of said middle common pinway into said top pinway portion of said first common pinway;

second set key means adapted for insertion into said keyway when said plug is in said second longitudinal position and being bitted for transferring said master pin means from said top pinway portion of said middle common pinway into said bottom pinway portion of said third common pinway;

each of said first and second set key means being adapted for rotating said plug to retain said master pin means in said respective top and bottom pinway portions; and said cam surface of said second groove being effective upon rotation of said plug to move said retainer means out of said second groove to allow said plug to slide longitudinally in said bore into said first position so that said common pinways are again formed and said master pin means is in said first common pinway when said first reset and set key means are used and in said third common pinway when said second reset and set key means are used to render said lock re-keyed for use with a change key adapted for use only when said master pin means is in said new common pinway location.

8. In a re-keyable lock for operation with differently bitted change keys, including a lock cylinder housing with a cylindrical bore extending therein from a first face to a second face, said housing having a series of holes therein for forming part of a series of pinways, a cylindrical plug having a longitudinal axis and a second series of holes therein for forming an opposite part of said series of pinways, said plug being mounted for longitudinal movement in said bore from a first operational position in which said opposite plug and housing holes form common pinways to a second re-keying position in which said housing pinways are opposite to said plug pinways to which they were adjacent in said operational position, the improvement which comprises:

a cut formed in said cylindrical plug transversely to said axis for form a transverse guideway that defines a neck section having a central shoulder and spaced sides extending therefrom;

a thin circular retainer member having a notch therein corresponding to said central shoulder and said spaced sides, said member being received in said guideway for movement transversely to said axis from a first position eccentric with respect to said axis for holding said plug in said operational position to a second position concentric with respect to said axis, the diameter of said member being no more than that of said plug so that in said concentric position said member allows axial movement of said plug in said bore, said member having a slot extending transversely therein;

said keyway extending longitudinally through said neck section to enable a key received in said keyway to engage said notch of said member and move said member in said guideway into said concentric position to release said plug for longitudinal movement into said re-keying position;

said bore having an arcuate groove formed therein transversely and eccentrically with respect to said axis for receiving said member in said re-keying position; and resilient means received in said slot for biasing said member into said guideway to releasable hold said member in said eccentric position in said groove;

said plug being rotatably received in said bore so that upon rotation of said plug said sides of said neck act on said member along said notch to rotate said member received in said arcuate groove and to render said groove effective to cam said member against said biasing means into said second concentric position to allow longitudinal movement of said plug into said operational position.

9. A re-keyable lock as recited in claim 8, wherein:

said cut formed in said plug is aligned with said second face when said plug is in said operational position so that said member overlaps said second face and retains said plug in said operational position;

said arcuate groove is formed in said bore at a given distance from said second face so that when said member is in said arcuate groove said housing holes are opposite to said adjacent plug holes; and a master pin is initially received in one of said common pinways, said master pin is movable across said shear interface between one of said opposed housing holes and said adjacent plug holes so that upon longitudinal movement of said plug back to said operational position said master pin is moved into a different one of said common pinways to require a new change key to operate said lock.

10. A set of keys for use in re-keying a lock that is initially operable by a master key and a first change key having first, middle and third station bittings so that said lock is not operable by said first change key and is operable by said master key and a second change key having first and third station bittings separated by a middle-station bitting that is shallower than said middle-station bitting of said first change key; said lock having a housing for slidably and rotatably receiving a plug provided with a longitudinally extending keyway and a retainer that is movable across an inner end of said housing to retain said plug in said housing with a series of holes in the housing and the plug aligned to form first, middle and third common pinways; said middle common pinway containing at least one master pin adapted to be transferred among said common pinways to require use of different ones of said change keys to operate said lock; said first, middle and third common pinways corresponding to said first, middle and third station bittings of said change keys; said retainer being retractable to allow said plus to slide partially out of the housing into a re-keying position so that pairs of said housing and plug holes that form said common pinways become aligned with adjacent ones of said holes to form re-keying pinways, said retainer being movable into a camway in said housing for holding said plug in said re-keying position and on rotation of said plug being cammed out of said camway to allow said plug to slide back into said housing to an operational position to form said common pinways, said set of keys comprising:

a first reset key adapted for insertion into said keyway to condition said master pin for being selectably transferred to said first common pinway, said first reset key having a middle-station bitting for positioning said master pin in said plug hole of said middle common pinway;

a second reset key adapted for insertion into said keyway to condition said master pin for being selectably transferred to said third common pinway, said second reset key having a middle-station bitting for positioning said master pin in said housing hole of said middle common pinway;

each of said first and second reset keys having means thereon effective upon said positioning of said master pin for retracting said retainer to allow said plug to slide to said re-keying position with said master pin conditioned for said selectable transfer;

a first set key adapted for insertion into said keyway with said plug in said re-keying position and after removal of said first reset key from said keyway, said first set key having a middle-station bitting for moving said master pin into said housing hole of said first common pinway to complete said transfer;

a second set key adapted for insertion into said keyway with said plug in said re-keying position and after removal of said second reset key from said keyway, said second set key having a middle-station bitting for moving said master pin into said plug hole of said third common pinway to complete said transfer;

each of said first and second set keys being adapted to rotate said plug after completion of said transfer to cam said retainer out of said camway and move said plug into said operational position, each of said set keys being longitudinally dimensioned to avoid contact with said retainer so that as said plug moves into said operational position said first and second set keys allow said retainer to move across said inner end of said housing to retain said plug in said operational position with said master pin in said first common pinway in response to use of said first reset and set keys and in said third common pinway in response to use of said second reset and set keys.

11. A set of keys for re-keying a lock as recited in claim 10, wherein:

six of said common pinways are provided in said lock at stations designated A through F that include said first, middle and third stations;

said master key is provided for use with said lock, said master key has bitting depths at the A through F stations of 0, 4, 3, 2, 1 and 0 respectively, where 0 is the shallowest depth and 9 is the deepest;

a minimum quantity of said first and second reset keys is provided for sequentially re-keying said lock for use with successive ones of up to twenty-one different change keys in the order in which said change keys are numbered, said reset keys are identified as in Column 1 below opposite "RESET" and are provided with said bittings at stations A through F as listed below in Column 2 opposite "RESET", where "RM", and "R" followed by a number, designate a particular reset key for use in re-keying from a given change key to the next successive change key, and where said first reset keys are designated at rows 8 through 11, 17 and 18 and said second reset keys are designated at rows 2 through 7, 12 through 16 and 19 through 21; and a minimum quantity of said first and second set keys is provided for sequentially re-keying said lock for use with said successive ones of up to twenty-one different change keys in the order in which said change keys are numbered, said set keys are indentified as in Column 1 below opposite "SET" and are provided with said bittings at said stations A through F as listed below in Column 2 opposite "SET", where "M" designates a master key for use as a set key, "S" followed by a number designates a particular set key, and "C" followed by a number designates a change key; and where said first set keys are designated at rows 8 through 11, 17 and 18 and said second set keys are designated at rows 2 through 7, 12 through 16 and 19:

| Column 1 Key Type and I.D. | | Column 2 Key Bittings | | | | | |
|---|---|---|---|---|---|---|---|
| | | A | B | C | D | E | F |
| CHANGE | C1 | 4 | 4 | 3 | 2 | 1 | 0 |
| RESET | RM | 0 | 4 | 3 | 2 | 1 | 0 |
| SET | S2 | 0 | 6 | 3 | 2 | 1 | 0 |
| CHANGE | C2 | 2 | 6 | 3 | 2 | 1 | 0 |
| RESET | RM | 0 | 4 | 3 | 2 | 1 | 0 |
| SET | S3 | 0 | 4 | 5 | 2 | 1 | 0 |
| CHANGE | C3 | 2 | 4 | 5 | 2 | 1 | 0 |
| RESET | RM | 0 | 4 | 3 | 2 | 1 | 0 |
| SET | S4 | 0 | 4 | 3 | 4 | 1 | 0 |
| CHANGE | C4 | 2 | 4 | 3 | 4 | 1 | 0 |
| RESET | RM | 0 | 4 | 3 | 2 | 1 | 0 |
| SET | S5 | 0 | 4 | 3 | 2 | 3 | 0 |
| CHANGE | C5 | 2 | 4 | 3 | 2 | 3 | 0 |
| RESET | RM | 0 | 4 | 3 | 2 | 1 | 0 |
| SET | S6 | 0 | 4 | 3 | 2 | 1 | 2 |
| CHANGE | C6 | 2 | 4 | 3 | 2 | 1 | 2 |
| RESET | RM | 0 | 4 | 3 | 2 | 1 | 0 |
| SET | S2 | 0 | 6 | 3 | 2 | 1 | 0 |
| CHANGE | C7 | 0 | 6 | 3 | 2 | 1 | 2 |
| RESET | R6 | 0 | 4 | 3 | 2 | 1 | 2 |
| SET | M | 0 | 4 | 3 | 2 | 1 | 0 |
| CHANGE | C8 | 0 | 6 | 3 | 2 | 3 | 0 |
| RESET | R5 | 0 | 4 | 3 | 2 | 3 | 0 |
| SET | M | 0 | 4 | 3 | 2 | 1 | 0 |
| CHANGE | C9 | 0 | 6 | 3 | 4 | 1 | 0 |
| RESET | R4 | 0 | 4 | 3 | 4 | 1 | 0 |
| SET | M | 0 | 4 | 3 | 2 | 1 | 0 |
| CHANGE | C10 | 0 | 6 | 5 | 2 | 1 | 0 |
| RESET | R3 | 0 | 4 | 5 | 2 | 1 | 0 |
| SET | M | 0 | 4 | 3 | 2 | 1 | 0 |
| CHANGE | C11 | 0 | 8 | 3 | 2 | 1 | 0 |
| RESET | RM | 0 | 4 | 3 | 2 | 1 | 0 |
| SET | S12 | 0 | 4 | 7 | 2 | 1 | 0 |
| CHANGE | C12 | 0 | 4 | 7 | 2 | 1 | 0 |
| RESET | RM | 0 | 4 | 3 | 2 | 1 | 0 |
| SET | S4 | 0 | 4 | 3 | 4 | 1 | 0 |
| CHANGE | C13 | 0 | 4 | 5 | 4 | 1 | 0 |
| RESET | RM | 0 | 4 | 3 | 2 | 1 | 0 |
| SET | S5 | 0 | 4 | 3 | 2 | 3 | 0 |
| CHANGE | C14 | 0 | 4 | 5 | 2 | 3 | 0 |
| RESET | RM | 0 | 4 | 3 | 2 | 1 | 0 |
| SET | S6 | 0 | 4 | 3 | 2 | 1 | 2 |
| CHANGE | C15 | 0 | 4 | 5 | 2 | 1 | 2 |
| RESET | RM | 0 | 4 | 3 | 2 | 1 | 0 |
| SET | S4 | 0 | 4 | 3 | 4 | 1 | 0 |
| CHANGE | C16 | 0 | 4 | 3 | 4 | 1 | 2 |
| RESET | R6 | 0 | 4 | 3 | 2 | 1 | 2 |
| SET | M | 0 | 4 | 3 | 2 | 1 | 0 |
| CHANGE | C17 | 0 | 4 | 3 | 4 | 3 | 0 |
| RESET | R5 | 0 | 4 | 3 | 2 | 3 | 0 |
| SET | M | 0 | 4 | 3 | 2 | 1 | 0 |
| CHANGE | C18 | 0 | 4 | 3 | 6 | 1 | 0 |
| RESET | RM | 0 | 4 | 3 | 2 | 1 | 0 |
| SET | C19 | 0 | 4 | 3 | 2 | 5 | 0 |
| CHANGE | C19 | 0 | 4 | 3 | 2 | 5 | 0 |
| RESET | RM | 0 | 4 | 3 | 2 | 1 | 0 |
| SET | S6 | 0 | 4 | 3 | 2 | 1 | 2 |
| CHANGE | C20 | 0 | 4 | 3 | 2 | 3 | 2 |
| RESET | RM | 0 | 4 | 3 | 2 | 1 | 0 |
| SET | S6 | 0 | 4 | 3 | 2 | 1 | 2 |
| CHANGE | C21 | 0 | 4 | 3 | 2 | 1 | 4 |

12. A set of keys for re-keying a lock as recited in claim 10, wherein:

six of said common pinways are provided in said lock at stations designated A through F that include said first, middle and third stations;

said master key is provided for use with said lock, said master key has bitting depths at the A through F stations of 0, 4, 3, 2, 1 and 0 respectively, where 0 is the shallowest depth and 9 is the deepest;

a minimum quantity of said first and second reset keys is provided for sequentially re-keying said lock for use with successive ones of up to thirty-six different change keys substantially in the order in which said change keys are numbered, said reset keys are identified as in Column 1 below opposite "RESET" and are provided with said bittings at stations A through F as listed below in Column 2 opposite "RESET", where "RM", and "R" followed by one or more numbers, designate a particular reset key for use in re-keying from a given change key to the next successive change key, and where said first reset keys are designated at rows 3, 9 through 13, 21 through 25 and 33 through 37 and said second reset keys are designated at the remaining rows; and a minimum quantity of said first and second set keys is provided for sequentially re-keying said lock for use with said successive ones of up to thirty-six different change keys in the order in which said change keys are numbered, said set keys are identified as in Column 1 below opposite "SET" and are provided with said bittings at said stations A through F as listed below in Column 2 opposite "SET", where "M" designates a master key for use as a set key, "S" followed by a number designates a particular set key, and "C" followed by a number designates a change key; and where said first set keys are designated at rows 3, 9 through 13, 21 through 25 and 33 through 37 and said second set keys are designated at the remaining rows:

| Row | Column 1 Key Type and I.D. | | Column 2 Key Bittings A | B | C | D | E | F |
|---|---|---|---|---|---|---|---|---|
| 1 | CHANGE | C1 | 5 | 4 | 3 | 2 | 1 | Ø |
| 2 | RESET | RM | Ø | 4 | 3 | 2 | 1 | Ø |
| | SET | C11 | Ø | 9 | 3 | 2 | 1 | Ø |
| | CHANGE | C11 | Ø | 9 | 3 | 2 | 1 | Ø |
| 3 | RESET | R7-12 | Ø | 7 | 3 | 2 | 1 | Ø |
| | SET | M | Ø | 4 | 3 | 2 | 1 | Ø |
| | CHANGE | C2 | 3 | 6 | 3 | 2 | 1 | Ø |
| 4 | RESET | RM | Ø | 4 | 3 | 2 | 1 | Ø |
| | SET | S3 | Ø | 4 | 5 | 2 | 1 | Ø |
| | CHANGE | C3 | 3 | 4 | 5 | 2 | 1 | Ø |
| 5 | RESET | RM | Ø | 4 | 3 | 2 | 1 | Ø |
| | SET | S4 | Ø | 4 | 3 | 4 | 1 | Ø |
| | CHANGE | C4 | 3 | 4 | 3 | 4 | 1 | Ø |
| 6 | RESET | RM | Ø | 4 | 3 | 2 | 1 | 0 |
| | SET | S5 | Ø | 4 | 3 | 2 | 3 | Ø |
| | CHANGE | C5 | 3 | 4 | 3 | 2 | 3 | Ø |
| 7 | RESET | RM | Ø | 4 | 3 | 2 | 1 | Ø |
| | SET | S6 | Ø | 4 | 3 | 2 | 1 | 2 |
| | CHANGE | C6 | 3 | 4 | 3 | 2 | 1 | 2 |
| 8 | RESET | RM | Ø | 4 | 3 | 2 | 1 | Ø |
| | SET | S7-12 | Ø | 7 | 3 | 2 | 1 | Ø |
| | CHANGE | C7 | Ø | 7 | 3 | 2 | 1 | 2 |
| 9 | RESET | R6 | Ø | 4 | 3 | 2 | 1 | 2 |
| | SET | M | Ø | 4 | 3 | 2 | 1 | Ø |
| | CHANGE | C8 | Ø | 7 | 3 | 2 | 3 | Ø |
| 1Ø | RESET | R5 | Ø | 4 | 3 | 2 | 3 | Ø |
| | SET | M | Ø | 4 | 3 | 2 | 1 | Ø |
| | CHANGE | C9 | Ø | 7 | 3 | 4 | 1 | Ø |
| 11 | RESET | R4 | Ø | 4 | 3 | 4 | 1 | Ø |
| | SET | M | Ø | 4 | 3 | 2 | 1 | Ø |
| | CHANGE | C1Ø | Ø | 7 | 5 | 2 | 1 | Ø |
| 12 | RESET | R1Ø | Ø | 7 | 5 | 2 | 1 | Ø |
| | SET | S7-12 | Ø | 7 | 3 | 2 | 1 | Ø |
| | CHANGE | C11 | Ø | 9 | 3 | 2 | 1 | Ø |
| 13 | RESET | R11 | Ø | 9 | 3 | 2 | 1 | Ø |

-continued

| Row | Column 1 Key Type and I.D. | | Column 2 Key Bittings A | B | C | D | E | F |
|---|---|---|---|---|---|---|---|---|
| | SET | S7-12 | Ø | 7 | 3 | 2 | 1 | Ø |
| | CHANGE | C12 | 2 | 7 | 3 | 2 | 1 | Ø |
| 14 | RESET | RM | Ø | 4 | 3 | 2 | 1 | Ø |
| | SET | S13-18 | Ø | 4 | 6 | 2 | 1 | Ø |
| | CHANGE | C13 | 2 | 4 | 6 | 2 | 1 | Ø |
| 15 | RESET | RM | Ø | 4 | 3 | 2 | 1 | Ø |
| | SET | S2 | Ø | 6 | 3 | 2 | 1 | Ø |
| | CHANGE | C14 | Ø | 6 | 6 | 2 | 1 | Ø |
| 16 | RESET | R13-18 | Ø | 4 | 6 | 2 | 1 | Ø |
| | SET | C15 | Ø | 4 | 8 | 2 | 1 | Ø |
| | CHANGE | C15 | Ø | 4 | 8 | 2 | 1 | Ø |
| 17 | RESET | R13—18 | Ø | 4 | 6 | 2 | 1 | Ø |
| | SET | C16 | Ø | 4 | 6 | 4 | 1 | Ø |
| | CHANGE | C16 | Ø | 4 | 6 | 4 | 1 | Ø |
| 18 | RESET | RM | Ø | 4 | 3 | 2 | 1 | Ø |
| | SET | S5 | Ø | 4 | 3 | 2 | 3 | Ø |
| | CHANGE | C17 | Ø | 4 | 6 | 2 | 3 | Ø |
| 19 | RESET | RM | Ø | 4 | 3 | 2 | 1 | Ø |
| | SET | S6 | Ø | 4 | 3 | 2 | 1 | 2 |
| | CHANGE | C18 | Ø | 4 | 6 | 2 | 1 | 2 |
| 2Ø | RESET | RM | Ø | 4 | 3 | 2 | 1 | Ø |
| | SET | S19-24 | Ø | 4 | 3 | 5 | 1 | Ø |
| | CHANGE | C19 | Ø | 4 | 3 | 5 | 1 | 2 |
| 21 | RESET | R6 | Ø | 4 | 3 | 2 | 1 | 2 |
| | SET | M | Ø | 4 | 3 | 2 | 1 | Ø |
| | CHANGE | C2Ø | Ø | 4 | 3 | 5 | 3 | Ø |
| 22 | RESET | R2Ø | Ø | 4 | 3 | 5 | 3 | Ø |
| | SET | S19-24 | Ø | 4 | 3 | 5 | 1 | Ø |
| | CHANGE | C21 | Ø | 4 | 3 | 7 | 1 | Ø |
| 23 | RESET | R21 | Ø | 4 | 3 | 7 | 1 | Ø |
| | SET | S19-24 | Ø | 4 | 3 | 5 | 1 | Ø |
| | CHANGE | C22 | Ø | 4 | 5 | 5 | 1 | Ø |
| 24 | RESET | R3 | Ø | 4 | 5 | 2 | 1 | Ø |
| | SET | M | Ø | 4 | 3 | 2 | 1 | Ø |
| | CHANGE | C23 | Ø | 6 | 3 | 5 | 1 | Ø |
| 25 | RESET | R2 | Ø | 6 | 3 | 2 | 1 | Ø |
| | SET | M | Ø | 4 | 3 | 2 | 1 | Ø |
| | CHANGE | C24 | 2 | 4 | 3 | 5 | 1 | Ø |
| 26 | RESET | RM | Ø | 4 | 3 | 2 | 1 | Ø |
| | SET | S25-3Ø | Ø | 4 | 3 | 2 | 4 | Ø |
| | CHANGE | C25 | 2 | 4 | 3 | 2 | 4 | Ø |
| 27 | RESET | RM | Ø | 4 | 3 | 2 | 1 | Ø |
| | SET | S2 | Ø | 6 | 3 | 2 | 1 | Ø |
| | CHANGE | C26 | Ø | 6 | 3 | 2 | 4 | Ø |
| 28 | RESET | RM | Ø | 4 | 3 | 2 | 1 | Ø |
| | SET | S3 | Ø | 4 | 5 | 2 | 1 | Ø |
| | CHANGE | C27 | Ø | 4 | 5 | 2 | 4 | Ø |
| 29 | RESET | RM | Ø | 4 | 3 | 2 | 1 | Ø |
| | SET | S4 | Ø | 4 | 3 | 4 | 1 | Ø |
| | CHANGE | C28 | Ø | 4 | 3 | 4 | 4 | Ø |
| 3Ø | RESET | R25-3Ø | Ø | 4 | 3 | 2 | 4 | Ø |
| | SET | C29 | Ø | 4 | 3 | 2 | 6 | Ø |
| | CHANGE | C29 | Ø | 4 | 3 | 2 | 6 | Ø |
| 31 | RESET | R25-3Ø | Ø | 4 | 3 | 2 | 4 | Ø |
| | SET | C3Ø | Ø | 4 | 3 | 2 | 4 | 2 |
| | CHANGE | C3Ø | Ø | 4 | 3 | 2 | 4 | 2 |
| 32 | RESET | RM | Ø | 4 | 3 | 2 | 1 | Ø |
| | SET | S31-36 | Ø | 4 | 3 | 2 | 1 | 3 |
| | CHANGE | C31 | Ø | 4 | 3 | 2 | 1 | 5 |
| 33 | RESET | R31 | Ø | 4 | 3 | 2 | 1 | 5 |
| | SET | S31-36 | Ø | 4 | 3 | 2 | 1 | 3 |
| | CHANGE | C32 | Ø | 4 | 3 | 2 | 3 | 3 |
| 34 | RESET | R5 | Ø | 4 | 3 | 2 | 3 | Ø |
| | SET | M | Ø | 4 | 3 | 2 | 1 | Ø |
| | CHANGE | C33 | Ø | 4 | 3 | 4 | 1 | 3 |
| 35 | RESET | R4 | Ø | 4 | 3 | 4 | 1 | Ø |
| | SET | M | Ø | 4 | 3 | 2 | 1 | Ø |
| | CHANGE | C34 | Ø | 4 | 5 | 2 | 1 | 3 |
| 36 | RESET | R3 | Ø | 4 | 5 | 2 | 1 | Ø |
| | SET | M | Ø | 4 | 3 | 2 | 1 | Ø |
| | CHANGE | C35 | Ø | 6 | 3 | 2 | 1 | 3 |
| 37 | RESET | R2 | Ø | 6 | 3 | 2 | 1 | Ø |
| | SET | M | Ø | 4 | 3 | 2 | 1 | Ø |
| | CHANGE | C36 | 2 | 4 | 3 | 2 | 1 | 3 |

13. A set of keys for re-keying a lock as recited in claim 12, wherein:

two master pins each having two-depths are provided in selected ones of said common pinways by using certain ones of said reset and set keys to render said lock usable by particular ones of said change keys, said master pin station locations being related to said reset and set keys according to the rows set forth in claim 11 as follows, where "2" below designates the location of one of said two-depth master pins:

| | Master Pin Station Location | | | | | |
|---|---|---|---|---|---|---|
| Row | A | B | C | D | E | F |
| 1 | 2 | | | | | |
| | 2 | | | | | |
| 2 | | | | | | |
| | 2 | 2 | | | | |
| 3 | | | | | | |
| | 2 | | 2 | | | |
| 4 | | | | | | |
| | 2 | | | 2 | | |
| 5 | | | | | | |
| | 2 | | | | 2 | |
| 6 | | | | | | |
| | 2 | | | | | 2 |
| 7 | | | | | | |
| | | 2 | | | | 2 |
| 8 | | | | | | |
| | | 2 | | | 2 | |
| 9 | | | | | | |
| | | 2 | | 2 | | |
| 10 | | | | | | |
| | | 2 | 2 | | | |
| 11 | | | | | | |
| | | 2 | | | | |
| | | 2 | | | | |
| 12 | | | | | | |
| | | | 2 | | | |
| | | | 2 | | | |
| 13 | | | | | | |
| | | | 2 | 2 | | |
| 14 | | | | | | |
| | | | 2 | | 2 | |
| 15 | | | | | | |
| | | | 2 | | | 2 |
| 16 | | | | | | |
| | | | | 2 | | 2 |
| 17 | | | | | | |
| | | | | 2 | 2 | |
| 18 | | | | | | |
| | | | | 2 | | |
| | | | | 2 | | |
| 19 | | | | | | |
| | | | | | 2 | |
| | | | | | 2 | |
| 20 | | | | | | |
| | | | | | 2 | 2 |
| 21 | | | | | | |
| | | | | | | 2 |
| | | | | | | 2 |

14. A set of keys for re-keying a lock as recited in claim 12, wherein:

a master pin having three-depths and a master pin having two-depths are provided in selected ones of said common pinways by using certain ones of said reset and set keys to render said lock usable by particular ones of said change keys, said master pin station locations being related to said reset and set keys according to the rows set forth in claim 12 as follows, where "2" below designates the location of said master pin having two-depths and "3" below designates the location of said masterpin having three-depths:

| | Column 1 Master Pin Positions | | | | | |
|---|---|---|---|---|---|---|
| Row | A | B | C | D | E | F |
| 1 | 2 | | | | | |
| | 3 | | | | | |
| 2 | | | | | | |
| | | 2 | | | | |
| | | 3 | | | | |
| 3 | | | | | | |
| | 3 | 2 | | | | |
| 4 | | | | | | |
| | 3 | | 2 | | | |
| 5 | | | | | | |
| | 3 | | | 2 | | |
| 6 | | | | | | |
| | 3 | | | | 2 | |
| 7 | | | | | | |
| | 3 | | | | | 2 |
| 8 | | | | | | |
| | | 3 | | | | 2 |
| 9 | | | | | | |
| | | 3 | | | 2 | |
| 10 | | | | | | |
| | | 3 | | 2 | | |
| 11 | | | | | | |
| | | 3 | 2 | | | |
| 12 | | | | | | |
| | | 2 | | | | |
| | | 3 | | | | |
| 13 | | | | | | |
| | 2 | 3 | | | | |
| 14 | | | | | | |
| | 2 | | 3 | | | |
| 15 | | | | | | |
| | | 2 | 3 | | | |
| 16 | | | | | | |
| | | | 2 | | | |
| | | | 3 | | | |
| 17 | | | | | | |
| | | | 3 | 2 | | |
| 18 | | | | | | |
| | | | 3 | | 2 | |
| 19 | | | | | | |
| | | | 3 | | | 2 |
| 20 | | | | | | |
| | | | | 3 | | 2 |
| 21 | | | | | | |
| | | | | 3 | 2 | |
| 22 | | | | | | |
| | | | | 2 | | |
| | | | | 3 | | |
| 23 | | | | | | |
| | | | 2 | 3 | | |
| 24 | | | | | | |
| | | 2 | | 3 | | |
| 25 | | | | | | |
| | 2 | | | 3 | | |
| 26 | | | | | | |
| | 2 | | | | 3 | |
| 27 | | | | | | |
| | | 2 | | | 3 | |
| 28 | | | | | | |
| | | | 2 | | 3 | |
| 29 | | | | | | |
| | | | | 2 | 3 | |
| 30 | | | | | | |
| | | | | | 2 | |
| | | | | | 3 | |
| 31 | | | | | | |
| | | | | | 3 | 2 |
| 32 | | | | | | |
| | | | | | | 2 |
| | | | | | | 3 |
| 33 | | | | | | |
| | | | | | 2 | 3 |
| 34 | | | | | | |
| | | | | 2 | | 3 |
| 35 | | | | | | |
| | | | 2 | | | 3 |
| 36 | | | | | | |

-continued

| Row | Column 1 Master Pin Positions A | B | C | D | E | F |
|---|---|---|---|---|---|---|
| | | 2 | | | | 3 |
| 37 | | | | | | |
| | 2 | | | | | 3 |

15. A method of re-keying a lock for use in succession with different ones of a plurality of different change keys and with a single master key without disassembling said lock or removing or replacing any parts therefrom or therein, said lock including a housing; a bore extending axially through said housing to define a shear interface; a plug received in said bore for rotational and axial movement, said housing and said plug having aligned holes therein forming at least first and second pinways that are axially spaced and that are divided by said shear interface; a first pin stack including a first tumbler pin, at least one master pin and a first driver pin received in said first pinway, and a second pin stack in said second pinway and including a second driver pin and a second tumbler pin; said method comprising the steps of:

holding said plug fixed axially with said aligned holes forming said first and second pinways;

positioning said master pin in said plug hole of said first pinway;

moving said plug axially to align said master pin with said second pinway;

moving said master pin across said shear interface into said hole of said second pinway;

rotating said plug to retain said master pin in said second pinway; and moving said plug axially to align said holes to form said first and second pinways with said master pin in said second pinway.

16. A method of re-keying a lock as recited in claim 15, wherein:

a reset key is provided having a bitting at a first station corresponding to said first pinway for positioning said master pin in said plug hole of said first pinway; and a set key is provided having a bitting at said first station for moving said master pin across said shear interface into said second pinway.

17. A method of re-keying a lock as recited in claim 15, wherein:

two of said master pins are provided, the second one of said master pins having a height of three-depths and being positioned in one of said first or second pinways to render said lock usable with a sub-master key; and said method includes the step of selectively positioning said second master pin among said pinways to re-key said lock for use with said change keys.

18. A method of re-keying a lock for use in succession with different ones of a plurality of different change keys and with a single master key without disassembling said lock or removing or replacing any parts therefrom or therein, said lock including a housing; a bore extending axially through said housing to define a shear interface; a plug received in said bore for rotational and axial movement, said housing and said plug having aligned holes therein forming at least first and second pinways that are axially spaced and that are divided by said shear interface; a first pin stack including a first tumbler pin, at least one master pin and a first driver pin received in said first pinway, and a second pin stack in said second pinway and including a second driver pin and a second tumbler pin; said method comprising the steps of:

holding said plug fixed axially with said aligned holes forming said first and second pinways;

positioning said master pin in said housing hole of said first pinway;

moving said plug axially to align said plug hole of said second pinway with said housing hole of said first pinway;

moving said master pin across said shear interface into said plug hole of said second pinway;

rotating said plug to retain said master pin in said plug hole of said second pinway; and moving said plug axially to align said holes to form said first and second pinways with said master pin in said second pinway.

19. A method of re-keying a lock as recited in claim 18, wherein:

a reset key is provided having a bitting at a first station corresponding to said first pinway for positioning said master pin in said housing hole of said first pinway; and a set key is provided having a bitting at said second station for moving said master pin across said shear interface into said plug hole of said second pinway.

20. A method of re-keying a lock as recited in claim 18, wherein:

two of said master pins are provided, the second one of said master pins having a height of three depths and being positioned in one of said first or second pinways to render said lock usable with a sub-master key; and said method includes the step of selectively positioning said second master pin among said pinways to re-key said lock for use with said change keys.

21. A method of re-keying a lock for use of a plurality of change keys that are identified as first through "nth" change keys, where "n" is greater than two and less than twenty-two, wherein only a given one of said change keys operates said lock for a given lock setting and wherein said lock is not disassembled nor parts added to nor removed therefrom to facilitate said re-keying, said method being effective to re-key said lock for successive use of said change keys in the sequence in which said change keys are identified, said lock including a housing; a bore extending axially through said housing to define a shear interface; a plug received in said bore for rotation therein and for axial movement between an operational position in which aligned holes in said housing and said plug form at least first and second pinways that are axially spaced and that are divided by said shear interface and a re-keying position in which said holes are opposite to adjacent ones of said holes; first and second pin stacks each including a first tumbler pin and a first driver pin; and two master pins for use in said pin stacks; said method comprising the steps of:

providing a set of reset keys and set keys having bittings and identifications as provided in Column 2 below for enabling successive use of said change keys in the sequence in which said change keys are identified in Column 2 below;

providing a set of set keys having bittings and identifications as provided in Column 2 below for enabling successive use of said change keys in said sequence in which said change keys are identified in Column 2 below;

initially providing said two master pins in selected ones of said pinways at stations A and B as shown in Column 1, Row 1 below to key said lock for use only by the change key that is identified as "C1";

re-keying said lock for successive use of the change keys that are identified as "2" through "n" by successively inserting into said keyway the reset key identified in the row following the row in which the current change key is listed and then selecting the set key identified in said following row;

said insertion of each said reset key being followed by the steps of retaining said reset key in said keyway while moving said plug axially and partially out of said bore into said re-keying position, then removing said reset key from said keyway;

upon removal of said reset key inserting said selected set key into said keyway and rotating said selected set key and said plug;

moving said plug back into said bore into said operational position; and removing said set key from said keyway to complete said re-keying for use of said next successive change key:

| | Column 1 Master Pin Positions | | | | | | Column 2 | | | | | | | |
|---|---|---|---|---|---|---|---|---|---|---|---|---|---|---|
| | | | | | | | Key Type | | Key Bittings | | | | | |
| Row | A | B | C | D | E | F | and I.D. | | A | B | C | D | E | F |
| 1 | 2 | | | | | | | | | | | | | |
| | 2 | | | | | | CHANGE | C1 | 4 | 4 | 3 | 2 | 1 | 0 |
| 2 | | | | | | | RESET | RM | 0 | 4 | 3 | 2 | 1 | 0 |
| | | | | | | | SET | S2 | 0 | 6 | 3 | 2 | 1 | 0 |
| | 2 | 2 | | | | | CHANGE | C2 | 2 | 6 | 3 | 2 | 1 | 0 |
| 3 | | | | | | | RESET | RM | 0 | 4 | 3 | 2 | 1 | 0 |
| | | | | | | | SET | S3 | 0 | 4 | 5 | 2 | 1 | 0 |
| | 2 | | 2 | | | | CHANGE | C3 | 2 | 4 | 5 | 2 | 1 | 0 |
| 4 | | | | | | | RESET | RM | 0 | 4 | 3 | 2 | 1 | 0 |
| | | | | | | | SET | S4 | 0 | 4 | 3 | 4 | 1 | 0 |
| | 2 | | | 2 | | | CHANGE | C4 | 2 | 4 | 3 | 4 | 1 | 0 |
| 5 | | | | | | | RESET | RM | 0 | 4 | 3 | 2 | 1 | 0 |
| | | | | | | | SET | S5 | 0 | 4 | 3 | 2 | 3 | 0 |
| | 2 | | | | 2 | | CHANGE | C5 | 2 | 4 | 3 | 2 | 3 | 0 |
| 6 | | | | | | | RESET | RM | 0 | 4 | 3 | 2 | 1 | 0 |
| | | | | | | | SET | S6 | 0 | 4 | 3 | 2 | 1 | 2 |
| | 2 | | | | | 2 | CHANGE | C6 | 2 | 4 | 3 | 2 | 1 | 2 |
| 7 | | | | | | | RESET | RM | 0 | 4 | 3 | 2 | 1 | 0 |
| | | | | | | | SET | S2 | 0 | 6 | 3 | 2 | 1 | 0 |
| | | 2 | | | | 2 | CHANGE | C7 | 0 | 6 | 3 | 2 | 1 | 2 |
| 8 | | | | | | | RESET | R6 | 0 | 4 | 3 | 2 | 1 | 2 |
| | | | | | | | SET | M | 0 | 4 | 3 | 2 | 1 | 0 |
| | | 2 | | | 2 | | CHANGE | C8 | 0 | 6 | 3 | 2 | 3 | 0 |
| 9 | | | | | | | RESET | R5 | 0 | 4 | 3 | 2 | 3 | 0 |
| | | | | | | | SET | M | 0 | 4 | 3 | 2 | 1 | 0 |
| | | 2 | | 2 | | | CHANGE | C9 | 0 | 6 | 3 | 4 | 1 | 0 |
| 10 | | | | | | | RESET | R4 | 0 | 4 | 3 | 4 | 1 | 0 |
| | | | | | | | SET | M | 0 | 4 | 3 | 2 | 1 | 0 |
| | | 2 | 2 | | | | CHANGE | C10 | 0 | 6 | 5 | 2 | 1 | 0 |
| 11 | | | | | | | RESET | R3 | 0 | 4 | 5 | 2 | 1 | 0 |
| | | 2 | | | | | SET | M | 0 | 4 | 3 | 2 | 1 | 0 |
| | | 2 | | | | | CHANGE | C11 | 0 | 8 | 3 | 2 | 1 | 0 |
| 12 | | | | | | | RESET | RM | 0 | 4 | 3 | 2 | 1 | 0 |
| | | | 2 | | | | SET | C12 | 0 | 4 | 7 | 2 | 1 | 0 |
| | | | 2 | | | | CHANGE | C12 | 0 | 4 | 7 | 2 | 1 | 0 |
| 13 | | | | | | | RESET | RM | 0 | 4 | 3 | 2 | 1 | 0 |
| | | | | | | | SET | S4 | 0 | 4 | 3 | 4 | 1 | 0 |
| | | | 2 | 2 | | | CHANGE | C13 | 0 | 4 | 5 | 4 | 1 | 0 |
| 14 | | | | | | | RESET | RM | 0 | 4 | 3 | 2 | 1 | 0 |
| | | | | | | | SET | S5 | 0 | 4 | 3 | 2 | 3 | 0 |
| | | | 2 | | 2 | | CHANGE | C14 | 0 | 4 | 5 | 2 | 3 | 0 |
| 15 | | | | | | | RESET | RM | 0 | 4 | 3 | 2 | 1 | 0 |
| | | | | | | | SET | S6 | 0 | 4 | 3 | 2 | 1 | 2 |
| | | | 2 | | | 2 | CHANGE | C15 | 0 | 4 | 5 | 2 | 1 | 2 |
| 16 | | | | | | | RESET | RM | 0 | 4 | 3 | 2 | 1 | 0 |
| | | | | | | | SET | S4 | 0 | 4 | 3 | 4 | 1 | 0 |
| | | | | 2 | | 2 | CHANGE | C16 | 0 | 4 | 3 | 4 | 1 | 2 |
| 17 | | | | | | | RESET | R6 | 0 | 4 | 3 | 2 | 1 | 2 |
| | | | | | | | SET | M | 0 | 4 | 3 | 2 | 1 | 0 |
| | | | | 2 | 2 | | CHANGE | C17 | 0 | 4 | 3 | 4 | 3 | 0 |
| 18 | | | | | | | RESET | R5 | 0 | 4 | 3 | 2 | 3 | 0 |
| | | | | 2 | | | SET | M | 0 | 4 | 3 | 2 | 1 | 0 |
| | | | | 2 | | | CHANGE | C18 | 0 | 4 | 3 | 6 | 1 | 0 |
| 19 | | | | | | | RESET | RM | 0 | 4 | 3 | 2 | 1 | 0 |
| | | | | | 2 | | SET | C19 | 0 | 4 | 3 | 2 | 5 | 0 |
| | | | | | 2 | | CHANGE | C19 | 0 | 4 | 3 | 2 | 5 | 0 |
| 20 | | | | | | | RESET | RM | 0 | 4 | 3 | 2 | 1 | 0 |
| | | | | | | | SET | S6 | 0 | 4 | 3 | 2 | 1 | 2 |
| | | | | | 2 | 2 | CHANGE | C20 | 0 | 4 | 3 | 2 | 3 | 2 |
| 21 | | | | | | | RESET | RM | 0 | 4 | 3 | 2 | 1 | 0 |
| | | | | | | 2 | SET | S6 | 0 | 4 | 3 | 2 | 1 | 2 |

-continued

| Row | Column 1 Master Pin Positions A | B | C | D | E | F | Column 2 Key Type and I.D. | | Key Bittings A | B | C | D | E | F |
|---|---|---|---|---|---|---|---|---|---|---|---|---|---|---|
| | | | | | | 2 | CHANGE | C21 | 0 | 4 | 3 | 2 | 1 | 4 |

22. A method of re-keying a lock for use of a plurality of change keys that are identified as first through "nth" change keys, where "n" is greater than two and less than thirty-seven, wherein only a given one of said change keys operates said lock for a given lock setting and wherein said lock is not disassembled nor parts added to nor removed therefrom to facilitate said re-keying, said method being effective to re-key said lock for successive use of said change keys in the sequence in which said change keys are identified, said lock including a housing; a bore extending axially through said housing to define a shear interface; a plug received in said bore for rotation therein and for axial movement between an operational position in which aligned holes in said housing and said plug form at least first and second pinways that are axially spaced and that are divided by said shear interface and a re-keyng position in which said holes are opposite to adjacent ones of said holes; first and second pin stacks each including a first tumbler pin and a first driver pin; and two master pins for use in said pin stacks; said method comprising the steps of:

providing a set of reset keys and set keys having bittings and identifications as provided in respective Columns 3 and 2 below for enabling successive use of said change keys in the sequence in which said change keys are identified in Column 2 below;

initially providing said two master pins in selected ones of said pinways at stations A and B as shown in Column 1, Row 1 below to key said lock for use only by the change key that is identified as "C1";

re-keying said lock for successive use of the change keys that are identified as "2" through "n" by successively inserting into said keyway the reset key identified in the row following the row in which the current change key is listed and then selecting the set key identified in said following row;

said insertion of each said reset key being followed by the steps of retaining said reset key in said keyway while moving said plug axially and partially out of said bore into said re-keying position, then removing said reset key from said keyway;

upon removal of said reset key inserting said selected set key into said keyway and rotating said selected set key and said plug;

moving said plug back into said bore into said operational position; and removing said set key from said keyway to complete said re-keying for use of said next successive change key:

| Row | Column 1 Master Pin Positions A | B | C | D | E | F | Column 2 Key Type and I.D. | | Column 3 Key Bittings A | B | C | D | E | F |
|---|---|---|---|---|---|---|---|---|---|---|---|---|---|---|
| 1 | 2 | | | | | | | | | | | | | |
| | 3 | | | | | | CHANGE | C1 | 5 | 4 | 3 | 2 | 1 | 0 |
| 2 | | | | | | | RESET | RM | 0 | 4 | 3 | 2 | 1 | 0 |
| | | 2 | | | | | SET | C11 | 0 | 9 | 3 | 2 | 1 | 0 |
| | | 3 | | | | | CHANGE | C11 | 0 | 9 | 3 | 2 | 1 | 0 |
| 3 | | | | | | | RESET | R7-12 | 0 | 7 | 3 | 2 | 1 | 0 |
| | | | | | | | SET | M | 0 | 4 | 3 | 2 | 1 | 0 |
| | 3 | 2 | | | | | CHANGE | C2 | 3 | 6 | 3 | 2 | 1 | 0 |
| 4 | | | | | | | RESET | RM | 0 | 4 | 3 | 2 | 1 | 0 |
| | | | | | | | SET | S3 | 0 | 4 | 5 | 2 | 1 | 0 |
| | 3 | | 2 | | | | CHANGE | C3 | 3 | 4 | 5 | 2 | 1 | 0 |
| 5 | | | | | | | RESET | RM | 0 | 4 | 3 | 2 | 1 | 0 |
| | | | | | | | SET | S4 | 0 | 4 | 3 | 4 | 1 | 0 |
| | 3 | | | 2 | | | CHANGE | C4 | 3 | 4 | 3 | 4 | 1 | 0 |
| 6 | | | | | | | RESET | RM | 0 | 4 | 3 | 2 | 1 | 0 |
| | | | | | | | SET | S5 | 0 | 4 | 3 | 2 | 3 | 0 |
| | 3 | | | | 2 | | CHANGE | C5 | 3 | 4 | 3 | 2 | 3 | 0 |
| 7 | | | | | | | RESET | RM | 0 | 4 | 3 | 2 | 1 | 0 |
| | | | | | | | SET | S6 | 0 | 4 | 3 | 2 | 1 | 2 |
| | 3 | | | | | 2 | CHANGE | C6 | 0 | 4 | 3 | 2 | 1 | 2 |
| 8 | | | | | | | RESET | RM | 3 | 4 | 3 | 2 | 1 | 0 |
| | | | | | | | SET | S7-12 | 0 | 7 | 3 | 2 | 1 | 0 |
| | | 3 | | | | 2 | CHANGE | C7 | 0 | 7 | 3 | 2 | 1 | 2 |
| 9 | | | | | | | RESET | R6 | 0 | 4 | 3 | 2 | 1 | 2 |
| | | | | | | | SET | M | 0 | 4 | 3 | 2 | 1 | 0 |
| | | 3 | | | 2 | | CHANGE | C8 | 0 | 7 | 3 | 2 | 3 | 0 |
| 10 | | | | | | | RESET | R5 | 0 | 4 | 3 | 2 | 3 | 0 |
| | | | | | | | SET | M | 0 | 4 | 3 | 2 | 1 | 0 |
| | | 3 | | 2 | | | CHANGE | C9 | 0 | 7 | 3 | 4 | 1 | 0 |
| 11 | | | | | | | RESET | R4 | 0 | 4 | 3 | 4 | 1 | 0 |
| | | | | | | | SET | M | 0 | 4 | 3 | 2 | 1 | 0 |
| | | 3 | 2 | | | | CHANGE | C10 | 0 | 7 | 5 | 2 | 1 | 0 |
| 12 | | | | | | | RESET | R10 | 0 | 7 | 5 | 2 | 1 | 0 |
| | | 2 | | | | | SET | S7-12 | 0 | 7 | 3 | 2 | 1 | 0 |
| | | 3 | | | | | CHANGE | C11 | 0 | 9 | 3 | 2 | 1 | 0 |
| 13 | | | | | | | RESET | R11 | 0 | 9 | 3 | 2 | 1 | 0 |

-continued

| Row | Column 1 Master Pin Positions A | B | C | D | E | F | Column 2 Key Type and I.D. | | Column 3 Key Bittings A | B | C | D | E | F |
|---|---|---|---|---|---|---|---|---|---|---|---|---|---|---|
| | | | | | | | SET | S7-12 | 0 | 7 | 3 | 2 | 1 | 0 |
| | 2 | 3 | | | | | CHANGE | C12 | 2 | 7 | 3 | 2 | 1 | 0 |
| 14 | | | | | | | RESET | RM | 0 | 4 | 3 | 2 | 1 | 0 |
| | | | | | | | SET | S13-18 | 0 | 4 | 6 | 2 | 1 | 0 |
| | 2 | | 3 | | | | CHANGE | C13 | 2 | 4 | 6 | 2 | 1 | 0 |
| 15 | | | | | | | RESET | RM | 0 | 4 | 3 | 2 | 1 | 0 |
| | | | | | | | SET | S2 | 0 | 6 | 3 | 2 | 1 | 0 |
| | | 2 | 3 | | | | CHANGE | C14 | 0 | 6 | 6 | 2 | 1 | 0 |
| 16 | | | | | | | RESET | R13-18 | 0 | 4 | 6 | 2 | 1 | 0 |
| | | | 2 | | | | SET | C15 | 0 | 4 | 8 | 2 | 1 | 0 |
| | | | 3 | | | | CHANGE | C15 | 0 | 4 | 8 | 2 | 1 | 0 |
| 17 | | | | | | | RESET | R13-18 | 0 | 4 | 6 | 2 | 1 | 0 |
| | | | | | | | SET | C16 | 0 | 4 | 6 | 4 | 1 | 0 |
| | | | 3 | 2 | | | CHANGE | C16 | 0 | 4 | 6 | 4 | 1 | 0 |
| 18 | | | | | | | RESET | RM | 0 | 4 | 3 | 2 | 1 | 0 |
| | | | | | | | SET | S5 | 0 | 4 | 3 | 2 | 3 | 0 |
| | | | 3 | | 2 | | CHANGE | C17 | 0 | 4 | 6 | 2 | 3 | 0 |
| 19 | | | | | | | RESET | RM | 0 | 4 | 3 | 2 | 1 | 0 |
| | | | | | | | SET | S6 | 0 | 4 | 3 | 2 | 1 | 2 |
| | | | 3 | | | 2 | CHANGE | C18 | 0 | 4 | 6 | 2 | 1 | 2 |
| 20 | | | | | | | RESET | RM | 0 | 4 | 3 | 2 | 1 | 0 |
| | | | | | | | SET | S19-24 | 0 | 4 | 3 | 5 | 1 | 0 |
| | | | | 3 | | 2 | CHANGE | C19 | 0 | 4 | 3 | 5 | 1 | 2 |
| 21 | | | | | | | RESET | R6 | 0 | 4 | 3 | 2 | 1 | 2 |
| | | | | | | | SET | M | 0 | 4 | 3 | 2 | 1 | 0 |
| | | | | 3 | 2 | | CHANGE | C20 | 0 | 4 | 3 | 5 | 3 | 0 |
| 22 | | | | | | | RESET | R20 | 0 | 4 | 3 | 5 | 3 | 0 |
| | | | | 2 | | | SET | S19-24 | 0 | 4 | 3 | 5 | 1 | 0 |
| | | | | 3 | | | CHANGE | C21 | 0 | 4 | 3 | 7 | 1 | 0 |
| 23 | | | | | | | RESET | R21 | 0 | 4 | 3 | 7 | 1 | 0 |
| | | | | | | | SET | S19-24 | 0 | 4 | 3 | 5 | 1 | 0 |
| | | | 2 | 3 | | | CHANGE | C22 | 0 | 4 | 5 | 5 | 1 | 0 |
| 24 | | | | | | | RESET | R3 | 0 | 4 | 5 | 2 | 1 | 0 |
| | | | | | | | SET | M | 0 | 4 | 3 | 2 | 1 | 0 |
| | | 2 | | 3 | | | CHANGE | C23 | 0 | 6 | 3 | 5 | 1 | 0 |
| 25 | | | | | | | RESET | R2 | 0 | 6 | 3 | 2 | 1 | 0 |
| | | | | | | | SET | M | 0 | 4 | 3 | 2 | 1 | 0 |
| | 2 | | | 3 | | | CHANGE | C24 | 2 | 4 | 3 | 5 | 1 | 0 |
| 26 | | | | | | | RESET | RM | 0 | 4 | 3 | 2 | 1 | 0 |
| | | | | | | | SET | S25-30 | 0 | 4 | 3 | 2 | 4 | 0 |
| | 2 | | | | 3 | | CHANGE | C25 | 2 | 4 | 3 | 2 | 4 | 0 |
| 27 | | | | | | | RESET | RM | 0 | 4 | 3 | 2 | 1 | 0 |
| | | | | | | | SET | S2 | 0 | 6 | 3 | 2 | 1 | 0 |
| | | 2 | | | 3 | | CHANGE | C26 | 0 | 6 | 3 | 2 | 4 | 0 |
| 28 | | | | | | | RESET | RM | 0 | 4 | 3 | 2 | 1 | 0 |
| | | | | | | | SET | S3 | 0 | 4 | 5 | 2 | 1 | 0 |
| | | | 2 | | 3 | | CHANGE | C27 | 0 | 4 | 5 | 2 | 4 | 0 |
| 29 | | | | | | | RESET | RM | 0 | 4 | 3 | 2 | 1 | 0 |
| | | | | | | | SET | S4 | 0 | 4 | 3 | 4 | 1 | 0 |
| | | | | 2 | 3 | | CHANGE | C28 | 0 | 4 | 3 | 4 | 4 | 0 |
| 30 | | | | | | | RESET | R25-30 | 0 | 4 | 3 | 2 | 4 | 0 |
| | | | | | 2 | | SET | C29 | 0 | 4 | 3 | 2 | 6 | 0 |
| | | | | | 3 | | CHANGE | C29 | 0 | 4 | 3 | 2 | 6 | 0 |
| 31 | | | | | | | RESET | R25-30 | 0 | 4 | 3 | 2 | 4 | 0 |
| | | | | | | | SET | C30 | 0 | 4 | 3 | 2 | 4 | 2 |
| | | | | | 3 | 2 | CHANGE | C30 | 0 | 4 | 3 | 2 | 4 | 2 |
| 32 | | | | | | | RESET | RM | 0 | 4 | 3 | 2 | 1 | 0 |
| | | | | | | 2 | SET | S31-36 | 0 | 4 | 3 | 2 | 1 | 3 |
| | | | | | | 3 | CHANGE | C31 | 0 | 4 | 3 | 2 | 1 | 5 |
| 33 | | | | | | | RESET | R31 | 0 | 4 | 3 | 2 | 1 | 5 |
| | | | | | | | SET | S31-36 | 0 | 4 | 3 | 2 | 1 | 3 |
| | | | | | 2 | 3 | CHANGE | C32 | 0 | 4 | 3 | 2 | 3 | 3 |
| 34 | | | | | | | RESET | R5 | 0 | 4 | 3 | 2 | 3 | 0 |
| | | | | | | | SET | M | 0 | 4 | 3 | 2 | 1 | 0 |
| | | | | 2 | | 3 | CHANGE | C33 | 0 | 4 | 3 | 4 | 1 | 3 |
| 35 | | | | | | | RESET | R4 | 0 | 4 | 3 | 4 | 1 | 0 |
| | | | | | | | SET | M | 0 | 4 | 3 | 2 | 1 | 0 |
| | | | 2 | | | 3 | CHANGE | C34 | 0 | 4 | 5 | 2 | 1 | 3 |
| 36 | | | | | | | RESET | R3 | 0 | 4 | 5 | 2 | 1 | 0 |
| | | | | | | | SET | M | 0 | 4 | 3 | 2 | 1 | 0 |
| | | 2 | | | | 3 | CHANGE | C35 | 0 | 6 | 3 | 2 | 1 | 3 |
| 37 | | | | | | | RESET | R2 | 0 | 6 | 3 | 2 | 1 | 0 |
| | | | | | | | SET | M | 0 | 4 | 3 | 2 | 1 | 0 |
| | 2 | | | | | 3 | CHANGE | C36 | 2 | 4 | 3 | 2 | 1 | 3 |

23. A method of re-keying a lock for use of a plurality of change keys, wherein only a given one of said change keys operates said lock for a given lock setting and wherein said lock is not disassembled nor parts added to nor removed therefrom to facilitate said re-keying, said method being effective to re-key said lock for successive use of said change keys in the sequence in which said change keys are identified, said lock including a housing; a bore extending axially through said housing to define a shear interface; a plug received in said bore for rotation therein and for axial movement between an operational position in which aligned holes in said housing and said plug form at least first and second pinways that are axially spaced and that are divided by said shear interface and a re-keying position in which said holes are opposite to adjacent ones of said holes; a first pin stack including a first tumbler pin and two master pins for use in said pin stacks; said method comprising the steps of:

providing a set of reset keys and set keys having bittings and identifications as provided in Columns 1 and 2 below for enabling successive use of said change keys in the sequence in which said change keys are identified in Column 1 below;

providing a set of reset keys and set keys having bittings and identifications as provided in Columns 2 and 3 below for enabling successive use of said change keys in the reverse sequence in which said change keys are numbered in Column 2 below;

identifying the specific change key that operates said lock;

re-keying said lock for use of a next change key identified in one of Columns 1 and 3 below that is numbered one different from said identified change key by identifying the row below that includes the change keys having the desired next higher or lower identification number and then selecting from one of Columns 1 and 3 the reset key that is identified in the selected row and then selecting the set key that is identified in said one Column and selected row;

inserting said selected reset key into said keyway, retaining said selected reset key in said keyway while pulling said plug partially out of said bore into said re-keying position;

removing said selected reset key from said keyway with said plug in said re-keying position;

inserting said selected set key into said keyway;

rotating said selected set key and said plug and then moving said plug back into said bore into said operational position; and retaining said plug in said operational position to enable operation of said lock using said next change key:

| Row | Column 1 Key Type and I.D. | | Column 2 Key Bittings A | B | C | D | E | F | Column 3 Key Type and I.D. | | Row |
|---|---|---|---|---|---|---|---|---|---|---|---|
| 1 | CHANGE | C1 | 5 | 4 | 3 | 2 | 1 | 0 | CHANGE | C1 | 1 |
| 2 | RESET | RM | 0 | 4 | 3 | 2 | 1 | 0 | SET | M | |
| | SET | C11 | 0 | 9 | 3 | 2 | 1 | 0 | RESET | R11 | |
| | CHANGE | C11 | 0 | 9 | 3 | 2 | 1 | 0 | CHANGE | C11 | 2 |
| 3 | RESET | R7-12 | 0 | 7 | 3 | 2 | 1 | 0 | SET | S7-12 | |
| | SET | M | 0 | 4 | 3 | 2 | 1 | 0 | RESET | RM | |
| | CHANGE | C2 | 3 | 6 | 3 | 2 | 1 | 0 | CHANGE | C2 | 3 |
| 4 | RESET | RM | 0 | 4 | 3 | 2 | 1 | 0 | SET | M | |
| | SET | S3 | 0 | 4 | 5 | 2 | 1 | 0 | RESET | R3 | |
| | CHANGE | C3 | 3 | 4 | 5 | 2 | 1 | 0 | CHANGE | C3 | 4 |
| 5 | RESET | RM | 0 | 4 | 3 | 2 | 1 | 0 | SET | M | |
| | SET | S4 | 0 | 4 | 3 | 4 | 1 | 0 | RESET | R4 | |
| | CHANGE | C4 | 3 | 4 | 3 | 4 | 1 | 0 | CHANGE | C4 | 5 |
| 6 | RESET | RM | 0 | 4 | 3 | 2 | 1 | 0 | SET | M | 5 |
| | SET | S5 | 0 | 4 | 3 | 2 | 3 | 0 | RESET | R5 | |
| | CHANGE | C5 | 3 | 4 | 3 | 2 | 3 | 0 | CHANGE | C5 | 6 |
| 7 | RESET | RM | 0 | 4 | 3 | 2 | 1 | 0 | SET | M | |
| | SET | S6 | 0 | 4 | 3 | 2 | 1 | 2 | RESET | R6 | |
| | CHANGE | C6 | 3 | 4 | 3 | 2 | 1 | 2 | CHANGE | C6 | 7 |
| 8 | RESET | RM | 0 | 4 | 3 | 2 | 1 | 0 | SET | M | |
| | SET | S7-12 | 0 | 7 | 3 | 2 | 1 | 0 | RESET | R7-12 | |
| | CHANGE | C7 | 0 | 7 | 3 | 2 | 1 | 2 | CHANGE | C7 | 8 |
| 9 | RESET | R6 | 0 | 4 | 3 | 2 | 1 | 2 | SET | S6 | |
| | SET | M | 0 | 4 | 3 | 2 | 1 | 0 | RESET | RM | |
| | CHANGE | C8 | 0 | 7 | 3 | 2 | 3 | 0 | CHANGE | C8 | 9 |
| 10 | RESET | R5 | 0 | 4 | 3 | 2 | 3 | 0 | SET | S5 | |
| | SET | M | 0 | 4 | 3 | 2 | 1 | 0 | RESET | RM | |
| | CHANGE | C9 | 0 | 7 | 3 | 4 | 1 | 0 | CHANGE | C9 | 10 |
| 11 | RESET | R4 | 0 | 4 | 3 | 4 | 1 | 0 | SET | S4 | |
| | SET | M | 0 | 4 | 3 | 2 | 1 | 0 | RESET | RM | |
| | CHANGE | C10 | 0 | 7 | 5 | 2 | 1 | 0 | CHANGE | C10 | 11 |
| 12 | RESET | R10 | 0 | 7 | 5 | 2 | 1 | 0 | SET | C10 | |
| | SET | S7-12 | 0 | 7 | 3 | 2 | 1 | 0 | RESET | R7-12 | |
| | CHANGE | C11 | 0 | 9 | 3 | 2 | 1 | 0 | CHANGE | C11 | 12 |
| 13 | RESET | R11 | 0 | 9 | 3 | 2 | 1 | 0 | SET | C11 | |
| | SET | S7-12 | 0 | 7 | 3 | 2 | 1 | 0 | RESET | R7-12 | |
| | CHANGE | C12 | 2 | 7 | 3 | 2 | 1 | 0 | CHANGE | C12 | 13 |
| 14 | RESET | RM | 0 | 4 | 3 | 2 | 1 | 0 | SET | M | |
| | SET | S13-18 | 0 | 4 | 6 | 2 | 1 | 0 | RESET | R13-18 | |
| | CHANGE | C13 | 2 | 4 | 6 | 2 | 1 | 0 | CHANGE | C13 | 14 |
| 15 | RESET | RM | 0 | 4 | 3 | 2 | 1 | 0 | SET | M | |
| | SET | S2 | 0 | 6 | 3 | 2 | 1 | 0 | RESET | R2 | |
| | CHANGE | C14 | 0 | 6 | 6 | 2 | 1 | 0 | CHANGE | C14 | 15 |
| 16 | RESET | R13-18 | 0 | 4 | 6 | 2 | 1 | 0 | SET | S13-18 | |
| | SET | C15 | 0 | 4 | 8 | 2 | 1 | 0 | RESET | R15 | |
| | CHANGE | C15 | 0 | 4 | 8 | 2 | 1 | 0 | CHANGE | C15 | 16 |

-continued

| Row | Column 1 Key Type and I.D. | | Column 2 Key Bittings A | B | C | D | E | F | Column 3 Key Type and I.D. | | Row |
|---|---|---|---|---|---|---|---|---|---|---|---|
| 17 | RESET | R13-18 | 0 | 4 | 6 | 2 | 1 | 0 | SET | S13-18 | |
| | SET | C16 | 0 | 4 | 6 | 4 | 1 | 0 | RESET | R16 | |
| | CHANGE | C16 | 0 | 4 | 6 | 4 | 1 | 0 | CHANGE | C16 | 17 |
| 18 | RESET | RM | 0 | 4 | 3 | 2 | 1 | 0 | SET | M | |
| | SET | S5 | 0 | 4 | 3 | 2 | 3 | 0 | RESET | R5 | |
| | CHANGE | C17 | 0 | 4 | 6 | 2 | 3 | 0 | CHANGE | C17 | 18 |
| 19 | RESET | RM | 0 | 4 | 3 | 2 | 1 | 0 | SET | M | |
| | SET | S6 | 0 | 4 | 3 | 2 | 1 | 2 | RESET | R6 | |
| | CHANGE | C18 | 0 | 4 | 6 | 2 | 1 | 2 | CHANGE | C18 | 19 |
| 20 | RESET | RM | 0 | 4 | 3 | 2 | 1 | 0 | SET | M | |
| | SET | S19-24 | 0 | 4 | 3 | 5 | 1 | 0 | RESET | R19-24 | |
| | CHANGE | C19 | 0 | 4 | 3 | 5 | 1 | 2 | CHANGE | C19 | 20 |
| 21 | RESET | R6 | 0 | 4 | 3 | 2 | 1 | 2 | SET | S6 | |
| | SET | M | 0 | 4 | 3 | 2 | 1 | 0 | RESET | RM | |
| | CHANGE | C20 | 0 | 4 | 3 | 5 | 3 | 0 | CHANGE | C20 | 21 |
| 22 | RESET | R20 | 0 | 4 | 3 | 5 | 3 | 0 | SET | C20 | 21 |
| | SET | S19-24 | 0 | 4 | 3 | 5 | 1 | 0 | RESET | R19-24 | |
| | CHANGE | C21 | 0 | 4 | 3 | 7 | 1 | 0 | CHANGE | C21 | 22 |
| 23 | RESET | R21 | 0 | 4 | 3 | 7 | 1 | 0 | SET | C21 | |
| | SET | S19-24 | 0 | 4 | 3 | 5 | 1 | 0 | RESET | R19-24 | |
| | CHANGE | C22 | 0 | 4 | 5 | 5 | 1 | 0 | CHANGE | C22 | 23 |
| 24 | RESET | R3 | 0 | 4 | 5 | 2 | 1 | 0 | SET | S3 | |
| | SET | M | 0 | 4 | 3 | 2 | 1 | 0 | RESET | RM | |
| | CHANGE | C23 | 0 | 6 | 3 | 5 | 1 | 0 | CHANGE | C23 | 24 |
| 25 | RESET | R2 | 0 | 6 | 3 | 2 | 1 | 0 | SET | S2 | |
| | SET | M | 0 | 4 | 3 | 2 | 1 | 0 | RESET | RM | |
| | CHANGE | C24 | 2 | 4 | 3 | 5 | 1 | 0 | CHANGE | C24 | 25 |
| 26 | RESET | RM | 0 | 4 | 3 | 2 | 1 | 0 | SET | M | |
| | SET | S25-30 | 0 | 4 | 3 | 2 | 4 | 0 | RESET | R25-30 | |
| | CHANGE | C25 | 2 | 4 | 3 | 2 | 4 | 0 | CHANGE | C25 | 26 |
| 27 | RESET | RM | 0 | 4 | 3 | 2 | 1 | 0 | SET | M | |
| | SET | S2 | 0 | 6 | 3 | 2 | 1 | 0 | RESET | R2 | |
| | CHANGE | C26 | 0 | 6 | 3 | 2 | 4 | 0 | CHANGE | C26 | 27 |
| 28 | RESET | RM | 0 | 4 | 3 | 2 | 1 | 0 | SET | M | |
| | SET | S3 | 0 | 4 | 5 | 2 | 1 | 0 | RESET | R3 | |
| | CHANGE | C27 | 0 | 4 | 5 | 2 | 4 | 0 | CHANGE | C27 | 28 |
| 29 | RESET | RM | 0 | 4 | 3 | 2 | 1 | 0 | SET | M | |
| | SET | S4 | 0 | 4 | 3 | 4 | 1 | 0 | RESET | R4 | |
| | CHANGE | C28 | 0 | 4 | 3 | 4 | 4 | 0 | CHANGE | C28 | 29 |
| 30 | RESET | R25-30 | 0 | 4 | 3 | 2 | 4 | 0 | SET | S25-30 | |
| | SET | C29 | 0 | 4 | 3 | 2 | 6 | 0 | RESET | R29 | |
| | CHANGE | C29 | 0 | 4 | 3 | 2 | 6 | 0 | CHANGE | C29 | 30 |
| 31 | RESET | R25-30 | 0 | 4 | 3 | 2 | 4 | 0 | SET | S25-30 | |
| | SET | C30 | 0 | 4 | 3 | 2 | 4 | 2 | RESET | R30 | |
| | CHANGE | C30 | 0 | 4 | 3 | 2 | 4 | 2 | CHANGE | C30 | 31 |
| 32 | RESET | RM | 0 | 4 | 3 | 2 | 1 | 0 | SET | M | |
| | SET | S31-36 | 0 | 4 | 3 | 2 | 1 | 3 | RESET | R31-36 | |
| | CHANGE | C31 | 0 | 4 | 3 | 2 | 1 | 5 | CHANGE | C31 | 32 |
| 33 | RESET | R31 | 0 | 4 | 3 | 2 | 1 | 5 | SET | C31 | |
| | SET | S31-36 | 0 | 4 | 3 | 2 | 1 | 3 | RESET | R31-36 | |
| | CHANGE | C32 | 0 | 4 | 3 | 2 | 3 | 3 | CHANGE | C32 | 33 |
| 34 | RESET | R5 | 0 | 4 | 3 | 2 | 3 | 0 | SET | S5 | |
| | SET | M | 0 | 4 | 3 | 2 | 1 | 0 | RESET | RM | |
| | CHANGE | C33 | 0 | 4 | 3 | 4 | 1 | 3 | CHANGE | C33 | 34 |
| 35 | RESET | R4 | 0 | 4 | 3 | 4 | 1 | 0 | SET | S4 | |
| | SET | M | 0 | 4 | 3 | 2 | 1 | 0 | RESET | RM | |
| | CHANGE | C34 | 0 | 4 | 5 | 2 | 1 | 3 | CHANGE | C34 | 35 |
| 36 | RESET | R3 | 0 | 4 | 5 | 2 | 1 | 0 | SET | S3 | |
| | SET | M | 0 | 4 | 3 | 2 | 1 | 0 | RESET | RM | |
| | CHANGE | C35 | 0 | 6 | 3 | 2 | 1 | 3 | CHANGE | C35 | 36 |
| 37 | RESET | R2 | 0 | 6 | 3 | 2 | 1 | 0 | SET | S2 | |
| | SET | M | 0 | 4 | 3 | 2 | 1 | 0 | RESET | RM | |
| | CHANGE | C36 | 2 | 4 | 3 | 2 | 1 | 3 | CHANGE | C36 | — |

24. A set of keys for use in re-keying a lock that is initially operable by a master key and by a first change key having first, middle and third station bittings so that said lock is not operable by said first change key and is operable by said master key and by a second change key having first and third station bittings separated by a middle-station bitting that is shallower than said middle-station bitting of said first change key; said lock having a housing for slidably and rotatably receiving a plug provided with a longitudinally extending keyway and a retainer that is movable across an inner end of said housing to retain said plug in said housing with a series of holes in the housing and the plug aligned to form first, middle and third common pinways; one of said common pinways containing at least one master pin adapted to be transferred among said common pinways to require use of different ones of said change keys to operate said lock; said first, middle and third common pinways corresponding to said first, middle and third station bittings of said change keys; said retainer being retractable to allow said plug to slide partially out of the housing into a re-keying position so that pairs of said housing and plug holes that originally formed said common pinways become aligned with adjacent ones of said holes to form re-keying pinways, said retainer being movable into a camway in said housing for holding said plug in said re-keying position and on rotation of said plug being cammed out of said camway to allow said plug to slide back into said housing to an operational position to again form said common pinways, said set of keys comprising:

reset key means adapted for insertion into said keyway to condition said master pin for being selectably transferred among said common pinways, said reset key means having a bitting at a station aligned with said master pin for selectably positioning said master pin in one of said plug hole and said housing hole of said common pinway aligned with said master pin, said reset key means having means thereon effective upon said positioning of said master pin for retracting said retainer to allow said plug to slide to said re-keying position with said master pin conditioned for said selectable transfer; and set key means adapted for insertion into said keyway with said plug in said re-keying position and after removal of said reset key means from said keyway, said set key means having a bitting at a station aligned with said master pin for selectably moving said master pin into one of said housing hole and said plug hole of said re-keying pinway in which said master pin is received according to said positioning of said master pin resulting from use of said reset key means to complete said transfer, said set key means being adapted to rotate said plug after completion of said transfer to cam said retainer out of said camway and move said plug into said operational position, said set key means being longitudinally dimensioned to avoid contact with said retainer so that as said plug moves into said operational position said set key means allows said retainer to move across said inner end of said housing to retain said plug in said operational position with said master pin in one of said first and third common pinways so that said lock is not operable by said first change key and is operable by said master key and said second change key.

25. A re-keyable lock apparatus including a lock that is initially operable by a master key and a first change key having first, second and third station bittings so that after re-keying said lock is not operable by said first change key and is operable by said master key and a second change key having first, second and third station bittings, wherein said second station bitting is shallower than said second station bitting of said first change key; said lock apparatus comprising:

a lock having a housing and a plug slidably and rotatably received in said housing and provided with a longitudinally extending keyway;

a retainer movable across an inner end of said housing to retain said plug in said housing;

said housing and said plug having a series of holes that are aligned to form first, second and third common pinways when said plug is retained in said housing;

at least one master pin in said second common pinway and adapted to be transferred among said other common pinways to require use of different ones of said change keys to operate said lock;

said first, second and third common pinways corresponding to said first, second and third station bittings of said change keys;

said retainer being retractable to allow said plug to slide partially out of said housing into a re-keying position so that pairs of said housing and plug holes that originally formed said common pinways become aligned with adjacent ones of said holes to form re-keying pinways;

said housing having a camway for receiving said retainer and holding said pliug in said re-keying position;

said retainer being cammed out of said camway on rotation of said plug to allow said plug to slide back into said housing to an operational position to again form said common pinways;

a reset key adapted for insertion into said keyway to condition said master pin for being selectably transferred among said other common pinways, said reset key having a bitting at a station aligned with said master pin for selectably positioning said master pin in one of said plug hole and said housing hole of said common pinway aligned with said master pin, said reset key having means thereon effective upon said positioning of said master pin for retracting said retainer to allow said plug to slide to said re-keying position with said master pin conditioned for said selectable transfer; and a set key adapted for insertion into said keyway with said plug in said re-keying position and after removal of said reset key from said keyway, said set key having a bitting at a station aligned with said master pin for selectably moving said master pin into one of said housing hole and said plug hole of said re-keying pinway in which said master pin is received, said selectable movement being according to said positioning of said master pin that results from use of said reset key, said set key being adapted to rotate said plug after said movement to cam said retainer out of said camway and move said plug into said operational position, said set key being longitudinally dimensioned to avoid contact with said retainer so that as said plug moves into said operational position said set key allows said retainer to move across said inner end of said housing to retain said plug in said operational position with said master pin in one of said first and third common pinways so that said lock is not operable by said first change key and is operable by said master key and said second change key.

26. A method of re-keying a lock for use in succession with different ones of a plurality of different change keys and with a single master key without disassembling said lock or removing or replacing any parts therefrom or therein, said lock including a housing; a bore extending axially through said housing to define a shear interface; a plug received in said bore for rotational and axial movement; said housing and said plug having aligned holes therein forming at least first, second and third pinways that are axially spaced and that are divided by said shear interface; a first pin stack including a first tumbler pin, at least one master pin and a first driver pin received in one of said pinways; and second and third pin stacks received in said other two pinways and including a second driver pin and a second tumbler pin; said method comprising the steps of:

holding said plug fixed axially with said aligned holes forming at least said first, second and third pinways;

selectively positioning said master pin relative to said shear interface;

moving said plug axially to align said master pin in said plug hole with a new housing hole with which it is not previously aligned or to align said master pin with a new plug hole with which it was not previously aligned;

selectively positioning said master pin relative to said shear interface so that said master pin moves across said shear interface into said new housing hole or said new plug hole;

rotating said plug to retain said master pin in said new housing hole or said new plug hole; and moving said plug axially to align said holes to again form said first, second and third pinways with said master pin in said new housing hole or said new plug hole so that a different successive change key is required for operating said lock.

27. In a lock for sequential exclusive use with at least first, second and third change keys and use with reset key means for re-keying said lock for use with only one of said change keys, said lock including a housing having an inner end; a bore extending through said housing along a longitudinal axis to define a shear interface; a plug rotatably received in said bore and having a keyway extending therein along said axis; said housing and said plug each having equal numbers of aligned holes therein forming portions of and combining to form at least first, second and third pinways that are spaced in the axial direction; a first tumbler stack including a first tumbler pin, a first driver pin and at least one master pin being received in said first pinway; said master pin separating said first driver pin from said first tumbler pin; and second tumbler stacks in said second and third pinways, each said second stack including a second driver pin and a second tumbler pin; the improvement comprising:

said plug being slidably received in said bore for movement from a normal axial position in which said aligned holes form said first and second pinways to a temporary re-keying axial position in which certain of the holes in said plug that normally form said pinways are axially displaced into alignment with different holes in said housing to permit transfer of said master pin into a selected one of said second and third pinways;

means rotatable in said bore with said plug and slidably mounted on said plug for releasably retaining said plug in said normal axial position, said retaining means having a central section intersecting said keyway, said retaining means having a retainer section extending from said central section transversely across said inner end of said housing for retaining said plug in said normal axial position, said central section being adapted to respond to said reset key means in said keyway to move said retainer section into said bore and release said plug for movement to said temporary re-keying axial position; and said bore having an arcuate slot formed therein transversely to said axial direction for receiving said retainer section of said retaining means to releasably retain said plug in said temporary re-keying axial position, said slot being formed eccentrically with respect to said arcuate section so that upon rotation of said plug said retainer section rides out of said slot to release said plug for axial movement in said bore to said normal axial position and to allow said retainer section to extend transversely across said inner end of said housing for retaining said plug in said normal axial position so that said master pin is in said selected one of said second and third pinways to render said lock usable only with a selected one of said second and third change keys.

* * * * *